US010145575B2

(12) United States Patent
Endo et al.

(10) Patent No.: US 10,145,575 B2
(45) Date of Patent: Dec. 4, 2018

(54) AIR CONDITIONER CONTROL SYSTEM, SENSOR DEVICE CONTROL METHOD, AND PROGRAM

(71) Applicant: Mitsubishi Electric Corporation, Tokyo (JP)

(72) Inventors: Satoshi Endo, Tokyo (JP); Yoshiaki Koizumi, Tokyo (JP); Toshihiro Mega, Tokyo (JP); Kazuo Tomisawa, Tokyo (JP); Tomoyuki Kamimura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 309 days.

(21) Appl. No.: 14/912,740

(22) PCT Filed: Aug. 29, 2014

(86) PCT No.: PCT/JP2014/072753
§ 371 (c)(1),
(2) Date: Feb. 18, 2016

(87) PCT Pub. No.: WO2015/030180
PCT Pub. Date: Mar. 5, 2015

(65) Prior Publication Data
US 2016/0201932 A1 Jul. 14, 2016

(30) Foreign Application Priority Data
Aug. 30, 2013 (JP) ..... 2013-179230

(51) Int. Cl.
*F24F 11/00* (2018.01)
*F24F 11/30* (2018.01)
(Continued)

(52) U.S. Cl.
CPC ..... *F24F 11/001* (2013.01); *F24F 11/30* (2018.01); *F24F 11/62* (2018.01); *F24F 11/70* (2018.01);
(Continued)

(58) Field of Classification Search
CPC ... G08C 2201/12; G06F 1/325; G06F 1/3265; H02J 7/0068; H04N 2005/4428; B60L 11/1844; B60L 11/1861; H01M 10/44
(Continued)

(56) References Cited

U.S. PATENT DOCUMENTS 5,365,160 A * 11/1994 Leppo ..... H02J 7/0024 320/160
5,616,968 A * 4/1997 Fujii ..... H02J 3/38 307/150
(Continued)

FOREIGN PATENT DOCUMENTS

JP H05-302749 A 11/1993
JP H08-122109 A 5/1996
(Continued)

OTHER PUBLICATIONS

International Search Report of the International Searching Authority dated Nov. 25, 2014 for the corresponding international application No. PCT/JP2014/072753 (and English translation).
(Continued)

*Primary Examiner* — Henry Crenshaw
(74) *Attorney, Agent, or Firm* — Posz Law Group, PLC

(57) ABSTRACT

An air conditioner control system comprises air conditioners configured to condition an environment in a target space, an integrated controller configured to control the air conditioners based on control parameter data, sensor devices configured to measure the temperature of the target space and transmit measurement data, and wireless master devices
(Continued)

configured to create control parameter data based on the measurement data. The wireless master devices each determine sleep times so that at least two sensor devices run out of battery charge around the same time according to the remaining charge amount of each of the sensor devices. The sensor devices each will be in the sleep mode in which power consumption is lower than in the normal mode according to the sleep time decided by the wireless master devices.

13 Claims, 20 Drawing Sheets

(51) Int. Cl.

| | |
|---|---|
| ***F24F 11/62*** | (2018.01) |
| ***F24F 11/70*** | (2018.01) |
| ***F24F 11/89*** | (2018.01) |
| *F24F 110/00* | (2018.01) |
| *F24F 11/63* | (2018.01) |
| *F24F 11/66* | (2018.01) |
| *F24F 11/56* | (2018.01) |

(52) U.S. Cl.
CPC ..... *F24F 11/89* (2018.01); *F24F 11/56* (2018.01); *F24F 11/63* (2018.01); *F24F 11/66* (2018.01); *F24F 2110/00* (2018.01)

(58) Field of Classification Search
USPC ..... 700/8, 9
See application file for complete search history.

(56) References Cited

U.S. PATENT DOCUMENTS

2004/0008651 A1* 1/2004 Ahmed ..... G05B 15/02 370/338
2006/0100002 A1 5/2006 Luebke et al.
2007/0202836 A1* 8/2007 Zaman ..... G06F 1/3203 455/343.2
2008/0212557 A1* 9/2008 Chiricescu ..... G01D 21/00 370/345
2009/0018785 A1 1/2009 Huseth et al.
2009/0066529 A1 3/2009 Fukada
2009/0168678 A1* 7/2009 Han ..... H04W 52/0225 370/311
2010/0106304 A1* 4/2010 Wawer ..... B60H 1/0065 700/275
2011/0033073 A1* 2/2011 Inoshita ..... H04R 25/552 381/323
2011/0139259 A1* 6/2011 Nagata ..... F24D 3/082 137/1
2013/0112877 A1* 5/2013 Hatano ..... G01J 5/10 250/338.1
2015/0323974 A1* 11/2015 Shuster ..... H04M 1/72563 713/320
2017/0176035 A1* 6/2017 Reeder ..... H04L 12/2816

FOREIGN PATENT DOCUMENTS

| | | | |
|---|---|---|---|
| JP | 10-122633 | A | 5/1998 |
| JP | 2004-287786 | A | 10/2004 |
| JP | 2007-132577 | A | 5/2007 |
| JP | 2009-063502 | A | 3/2009 |
| JP | 2010-048531 | A | 3/2010 |
| JP | 2010-206724 | A | 9/2010 |
| JP | 2011-174702 | A | 9/2011 |
| JP | 2013-120582 | A | 6/2013 |
| KR | 1020090017008 | A | 2/2009 |

OTHER PUBLICATIONS

Office Action dated Sep. 27, 2017 in corresponding KR patent application No. 10-2016-7007625 (and English translation attached).
Extended European Search Report dated Apr. 18, 2017 issued in the corresponding EP application No. 14840321.5.

* cited by examiner

AIR CONDITIONER CONTROL SYSTEM, SENSOR DEVICE CONTROL METHOD, AND PROGRAM

CROSS REFERENCE TO RELATED APPLICATIONS

This application is a U.S. national stage application of International Patent Application No. PCT/JP2014/072753 filed on Aug. 29, 2014, which claims priority to Japanese Patent Application No. 2013-179230 filed on Aug. 30, 2013, the disclosures of which are incorporated herein by reference.

TECHNICAL FIELD

The present disclosure relates to an air conditioner control system, sensor device control method, and program.

BACKGROUND ART

Patent Literature 1 discloses an air conditioning system conditioning the air in an air-conditioning area based on the temperature measured by a wireless measurement terminal. The wireless measurement terminal is powered by a battery and detects the remaining charge amount of the battery. Then, when the battery dies or the remaining charge amount falls below a given value, the wireless measurement terminal notifies a monitoring device and the monitoring device notifies a remote monitoring device for ensuring maintenance work is done.

CITATION LIST

Patent Literature

Patent Literature 1: Unexamined Japanese Patent Application Kokai Publication No. 2011-174702.

SUMMARY OF INVENTION

Technical Problem

When multiple wireless measurement terminals are provided, in many cases, their batteries die or their remaining charge amounts fall below a given value at different times depending on the wireless measurement terminals. Therefore, a problem is that the batteries are replaced at different times for each wireless measurement terminal, whereby the maintenance work is laborious.

The present disclosure is made with the view of the above circumstance and an objective of the disclosure is to provide an air conditioner control system and the like making it possible to reduce maintenance-related labor accompanying exhaustion of the batteries.

Solution to Problem

In order to achieve the above objective, the air conditioner control system according to the present disclosure comprises one or more air conditioners configured to condition an environment in a target space, an integrated controller configured to communicate with the one or more air conditioners, a relay device configured to communicate with the integrated controller, and a plurality of sensor devices each comprising a battery supplying power for operation and configured to wirelessly communicate with the relay device.

The integrated controller comprises air conditioner control means for controlling the one or more air conditioners based on control parameter data.

Each of the sensor devices comprises measuring means for measuring an environment value of the target space and sending measurement data including the measured environment value to the relay device and sleep control means for effecting, according to a sleep time decided by the relay device, a sleep mode in which power consumption is lower than in a normal mode.

The relay device comprises control parameter creation means for creating the control parameter data based on the measurement data received from each of the plurality of sensor devices and sleep time deciding means for deciding, according to the remaining charge amounts of the batteries, the sleep time so that at least two sensor devices of the plurality of sensor devices run out of battery charge around the same time.

Advantageous Effects of Invention

According to the present disclosure, the sleep time is decided according to the remaining charge amounts of the batteries so that at least two sensor devices run out of battery charge around the same time. The sensor devices will be in the sleep mode in which power consumption is lower than in the normal mode according to the decided sleep time thereof. As a result, the batteries of two or more sensor devices can be replaced around the same time. Therefore, it is possible to reduce maintenance-related labor accompanying exhaustion of the batteries.

DESCRIPTION OF EMBODIMENTS

Embodiments of the present disclosure will be described with reference to the drawings. Throughout the drawings, the same components are referred to by the same reference numbers.

Embodiment 1

Figure 1:
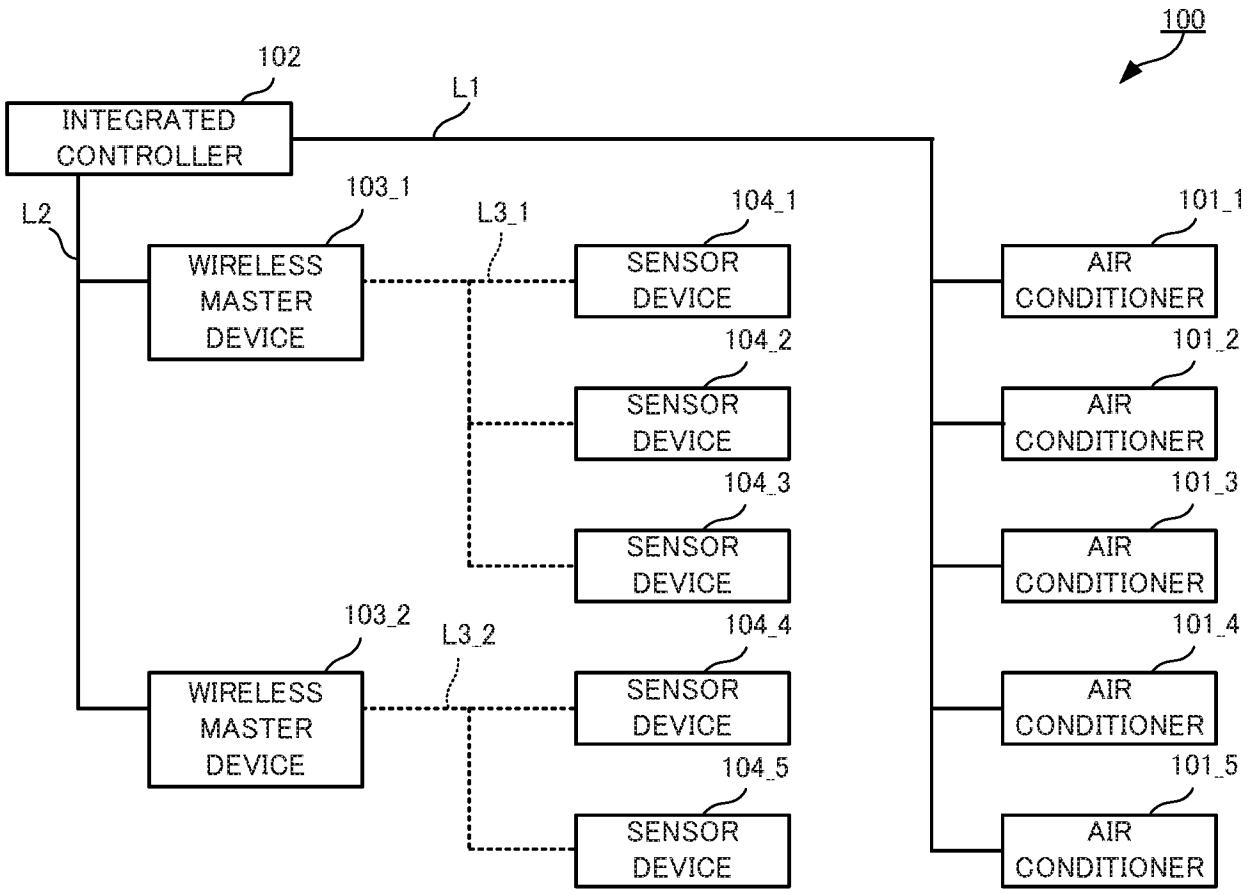
FIG. 1 is a diagram showing the configuration of the air conditioner control system according to Embodiment 1 of the present disclosure.

An air conditioner control system 100 according to Embodiment 1 of the present disclosure is a system for conditioning the environment in a target space. The air conditioner control system 100 comprises, as shown in FIG. 1, air conditioners 101_1 to _5 as facility apparatuses conditioning the environment in a target space, an integrated controller 102 controlling the air conditioners 101_1 to _5, wireless master devices (relay devices) 103_1 and _2 creating control parameters for controlling each of the air conditioners 101_1 to _5, and sensor devices 104_1 to _5 measuring the temperatures for creating the control parameters.

As shown in the same figure, the air conditioners 101_1 to _5 and the integrated controller 102 are connected by a wired communication line L1. The integrated controller 102 and the wireless master devices 103_1 and _2 are connected by a wired communication line L2. The wireless master device 103_1 and the sensor devices 104_1 to _3 are connected by a wireless communication line L3_1. The wireless master device 103_2 and the sensor devices 104_4 and _5 are connected by a wireless communication line L3_2.

Figure 2:
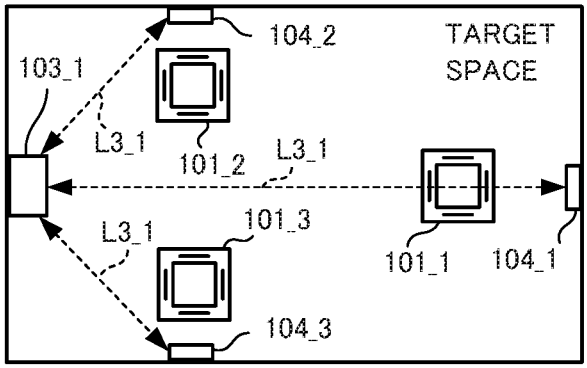
FIG. 2 is an illustration showing an exemplary positional relationship among air conditioners, a wireless master device, and sensor devices in a target space according to Embodiment 1.

The air conditioners 101_1 to _5 are associated with the sensor devices 104_1 to _5, respectively, and controlled with control parameters based on the temperatures measured by the corresponding sensor devices 104_1 to _5. For example, FIG. 2 shows a case in which in order for the air conditioners 101_1 to _3 to condition the environment in the same target space, the corresponding sensor devices 104_1 to _3 are installed near the air conditioners 101_1 to _3, respectively. The target space is, for example, a room in a building. Although not shown, the air conditioners 101_4 and _5 are installed, for example, in another room different from the target space of the air conditioners 101_1 to _3 as the target space along with the sensor devices 104_4 and _5 associated with the air conditioners 101_4 and _5, respectively.

In the following explanation, the air conditioners 101_1 to _5 are referred to by an air conditioner 101 or air conditioners 101 when they are not particularly distinguished. The wireless master devices 103_1 and _2 are referred to by a wireless master device 103 or wireless master devices 103 when they are not particularly distinguished. The sensor devices 104_1 to _5 are referred to by a sensor device 104 or sensor devices 104 when they are not particularly distinguished. The wireless communication lines L3_1 and _2 are referred to by a wireless communication line L3 or wireless communication lines L3 when they are not particularly distinguished.

Figure 3:
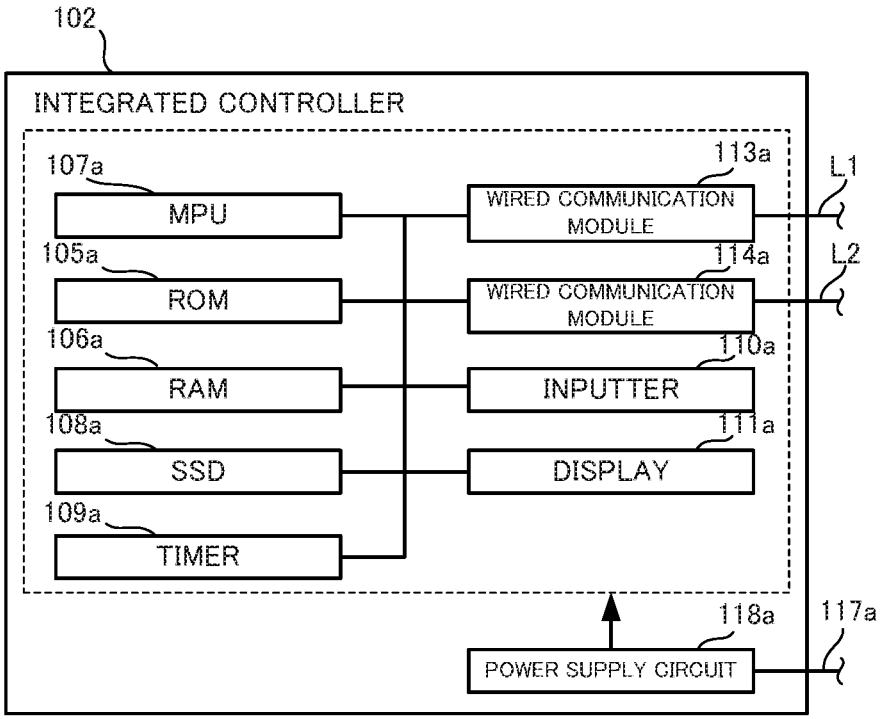
FIG. 3 is a diagram showing the physical configuration of the integrated controller according to Embodiment 1.
Figure 4:
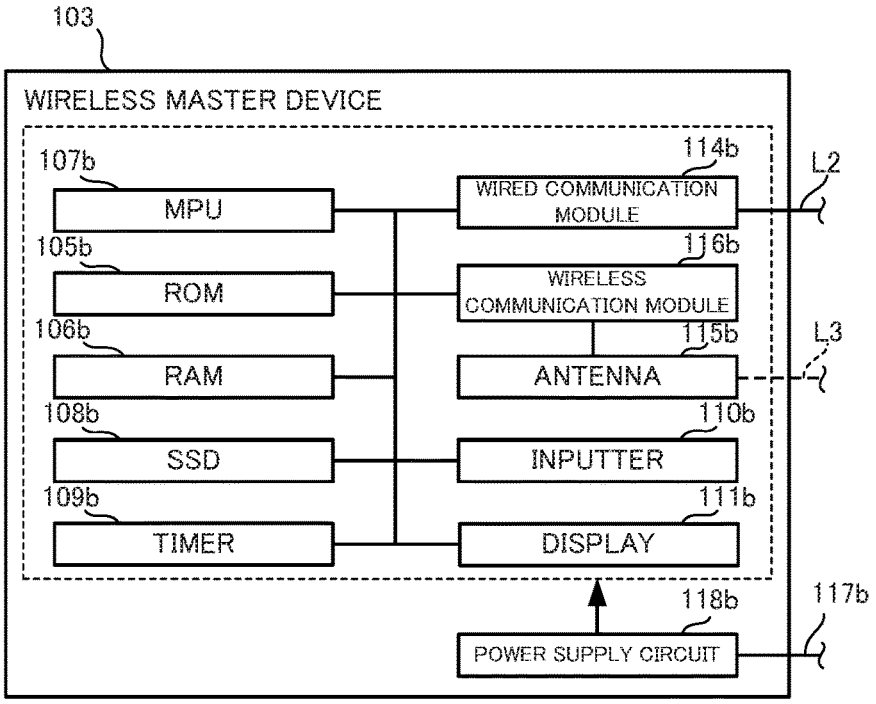
FIG. 4 is a diagram showing the physical configuration of a wireless master device according to Embodiment 1.
Figure 5:
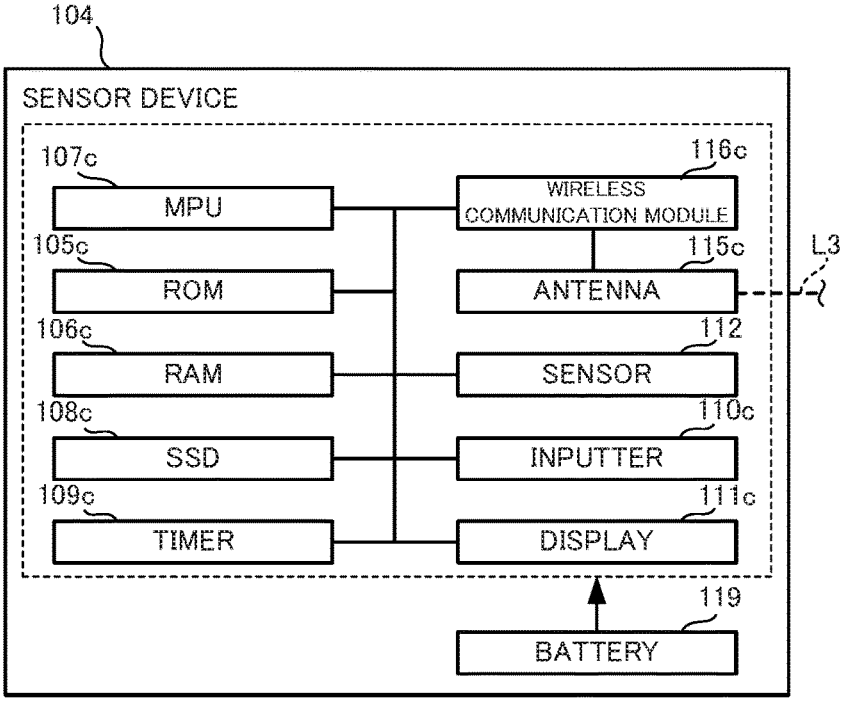
FIG. 5 is a diagram showing the physical configuration of a sensor device according to Embodiment 1.

The integrated controller 102, wireless master devices 103, and sensor devices 104 each comprise, as shown in FIGS. 3 to 5 showing their physical configuration, a micro processing unit (MPU) 107*a*, 107*b*, or 107*c* making reference to data stored in a read only memory (ROM) 105*a*, 105*b*, or 105*c* and operating with the use of a random access memory (RAM) 106*a*, 106*b*, or 106*c* as the work area, a solid state drive (SSD) 108*a* 108*b*, or 108*c* for storing various data, a timer 109*a*, 109*b*, or 109*c* for measuring the time, an inputter 110*a* 110*b*, or 110*c* such as buttons and a touch panel for the user to set various data, and a display 111*a*, 111*b*, or 111*c* such as a liquid crystal display, organic EL display, or the like for presenting information to the user.

The sensor devices 104 each further comprise, as shown in FIG. 5, a sensor 112 measuring the temperature. Here, the temperature is an exemplary value regarding the environment in the target space (an environment value). When the environment value is, for example, the humidity, illuminance, or the like, the sensor 112 may be a sensor measuring the humidity, illuminance, or the like.

The integrated controller 102 further comprises a wired communication module 113*a* to which the wired communication line L1 is connected, and thereby mutually connected to the air conditioners 101 via the communication line L1. The integrated controller 102 and the wireless master devices 103 each further comprise a wired communication module 114*a* or 114*b* to which the wired communication line L2 is connected, and thereby communicate with each other via the communication line L2. The wireless master devices 103 and sensor devices 104 each comprise an antenna 115*b* or 115*c* to which the wireless communication line L3 is connected and a wireless communication module 116*b* or 116*c*, and thereby communicate with each other via the communication line L3. The wired communication modules 113*a*, 114*a*, and 114*b* each comprise, for example, a connector connecting the communication line, a transceiver circuit, and the like.

The integrated controller 102 and the wireless master devices 103 each further comprise, as shown in FIGS. 3 and 4, a power supply circuit 118*a* or 118*b* connected to a lamp line 117*a* or 117*b*, and operate with the power supplied from the power supply circuit 118*a* or 118*b*. The sensor devices 104 further comprise, as shown in FIG. 5, a battery 119 such as a primary battery and a secondary battery, and operate with the power supplied from the battery 119. The sensor devices 104 communicate via the wireless communication line L3 and operate with the battery 119, and therefore can be installed at a desired location by the user, an installation worker, or the like.

Here, only one air conditioner 101 may be controlled by the integrated controller 102. Only one wireless master device 103 may be connected to the integrated controller 102 via the communication line L2. Multiple sensor devices 104 may be associated with one air conditioner 101. Only one sensor device 104 may be associated with multiple air conditioners 101. The air conditioners 101_1 to _5 and the integrated controller 102 may comprise a wireless communication module for connecting them and be connected via a wireless communication line. The integrated controller 102 and wireless master devices 103_1 and _2 may comprise a wireless communication module for connecting them and be connected via a wireless communication line.

Figure 6:
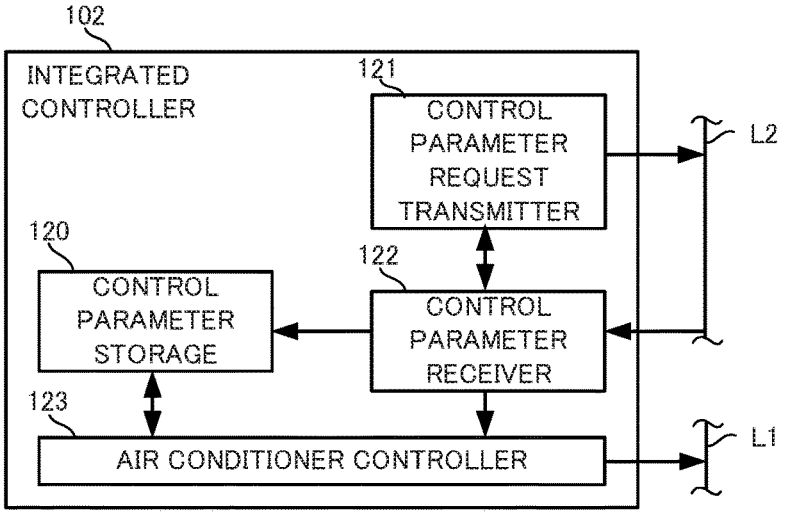
FIG. 6 is a diagram showing the functional configuration of the integrated controller according to Embodiment 1.
Figure 7:
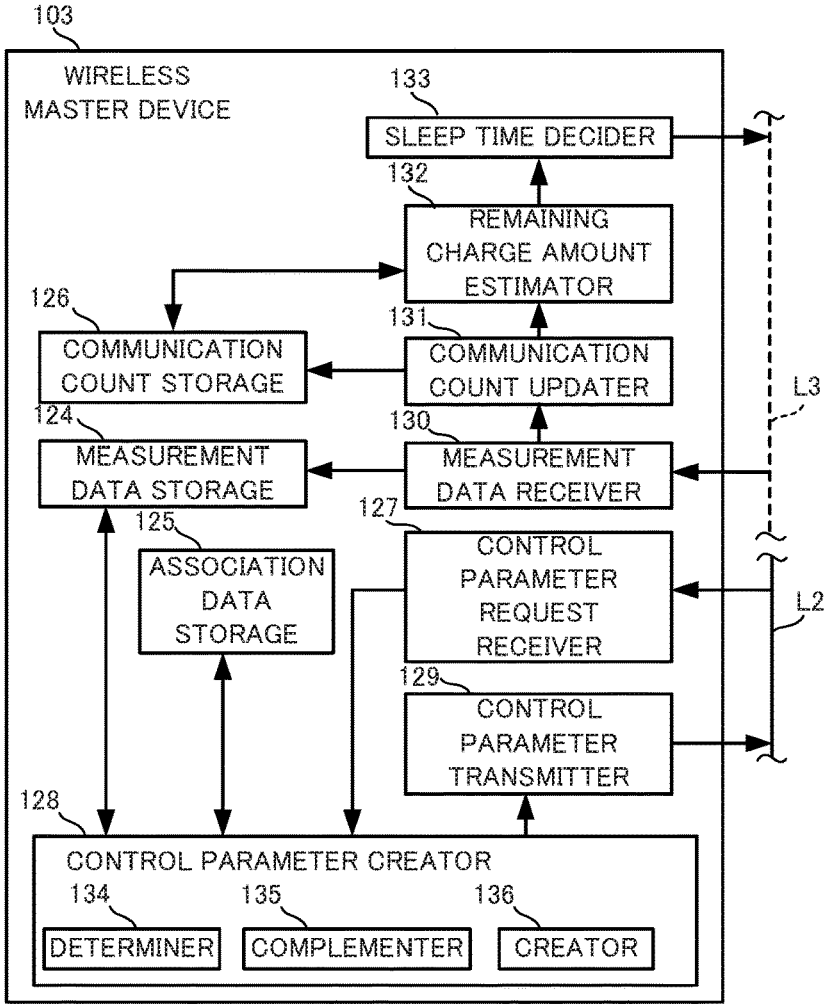
FIG. 7 is a diagram showing the functional configuration of a wireless master device according to Embodiment 1.
Figure 8:
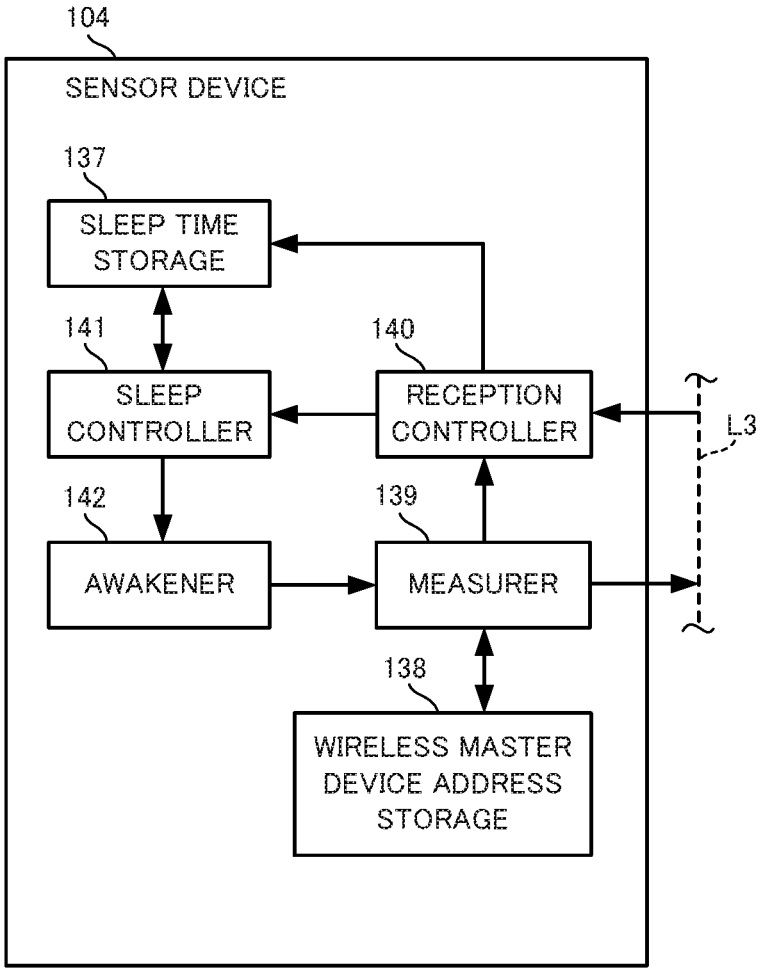
FIG. 8 is a diagram showing the functional configuration of a sensor device according to Embodiment 1.

The integrated controller 102, the wireless master devices 103, and the sensor devices 104 each fulfill their functions shown in FIGS. 6 to 8 by, for example, cooperation of the MPU 107*a*, 107*b*, or 107*c* executing preinstalled software programs, the SSD 108*a*, 108*b*, or 108*c* storing data, and the like.

(Functional Configuration of the Integrated Controller 102)

As shown in FIG. 6, the integrated controller 102 comprises a control parameter storage 120 storing control parameter data.

The control parameter data includes, in addition to control parameters for controlling the air conditioners 101, identification data (ID) of the air conditioners 101 to which the control parameters are applied. Data includes any unique codes, numerical values, and the like for each of the air conditioners 101 and may be used as the ID of the air conditioners 101. In this embodiment, the communication addresses of the air conditioners 101 are used.

As shown in the same figure, the integrated controller 102 further comprises a control parameter request transmitter 121 requesting control parameter data, a control parameter receiver 122 receiving the control parameter data, and an air conditioner controller 123 controlling each of the air conditioners 101 based on the control parameter data.

For example, when the last control parameter data is received by the control parameter receiver 122, the control parameter request transmitter 121 measures the elapsed time since then. As the measured elapsed time reaches a predetermined control parameter acquisition time, the control parameter request transmitter 121 sends a control parameter request to each of the wireless master devices 103_1 and _2 in sequence. The control parameter request is data presenting a request for the wireless master devices 103 to send control parameter data.

The control parameter receiver 122 receives control parameter data from each of the wireless master devices 103_1 and _2 as a response to the control parameter request. The control parameter receiver 122 passes on the received control parameter data to the control parameter storage 120. As a result, the control parameter storage 120 stores the acquired control parameter data.

The air conditioner controller 123 extracts the control parameter data for each of the air conditioners 101 that are received by the control parameter receiver 122 most recently from the control parameter storage 120, for example, at predetermined time intervals. The air conditioner controller 123 controls the corresponding air conditioner 101 based on each of the extracted control parameter data. The corresponding air conditioner 101 is the air conditioner 101 presented by the communication address included in each of the extracted control parameter data. As a result, the air conditioners 101 each operate to condition the environment in the target space.

(Functional Configuration of the Wireless Master Devices 103)

As shown in FIG. 7, the wireless master devices 103 comprise a measurement data storage 124 storing measurement data, an association data storage 125 storing association data, and a communication count storage 126 storing communication count data.

The measurement data includes an ID of a sensor device 104, temperatures measured by the sensor device 104, and times of measurement by the sensor device 104. The ID of a sensor device 104 according to this embodiments are the communication address of the sensor device 104. Here, the ID of the sensor devices 104 are not limited to the communication address of the sensor device 104 and data including a unique code, numerical value, or the like to each of the sensor devices 104 may be used as appropriate.

The association data are data in which the ID of the air conditioners 101 is associated with the ID of the sensor devices 104. The association in the association data generally matches the association at the time of installation. Therefore, in this embodiment, the association data associate the air conditioners 101_1 to _5 with the sensor devices 104_1 to _5 one-by one, respectively.

The communication count data includes the ID of a sensor device 104 and the number of times of communication with the sensor device 104 since the battery 119 of the sensor device 104 is replaced.

As shown in the same figure, the wireless master devices 103 further comprise a control parameter request receiver 127 receiving a control parameter request, a control parameter creator 128 creating control parameter data, a control parameter transmitter 129 transmitting the control parameter data, a measurement data receiver 130 receiving measurement data, a communication count updater 131 updating the communication count data in the communication count storage 126, a remaining battery charge amount estimator 132 estimating the remaining charge amounts of the batteries 119 of the sensor devices 104, and a sleep time decider 133 deciding the sleep times of the sensor devices 104.

The control parameter request receiver 127 receives a control parameter request from the integrated controller 102.

The control parameter creator 128 creates control parameter data for each of the air conditioners 101 based on the measurement data stored in the measurement data storage 124.

The control parameter creator 128 has, as shown in the same figure, a determiner 134 determining whether measurement data including the most recent temperature are received from each of the sensor devices 104, and a complementer 135 and a creator 136 creating control parameter data according to the determination result of the determiner 134. When there is a sensor device 104 from which no measurement data including the most recent temperature is received, the complementer 135 obtains a most recent temperature that would be measured by the sensor device 104 by complementation so as to create control parameter data. When there is a sensor device 104 from which measurement data including the most recent temperature is received, the creator 136 creates control parameter data including the most recent temperature. The most recent temperature is the temperature that is measured (or would be measured) within a predetermined time period since the current time. The predetermined time period here may be zero. In such a case, the most recent temperature means the current temperature.

The determiner 134 determines whether measurement data including the most recent temperature is received from each of the sensor devices 104 based on the measurement data in the measurement data storage 124. In more detail, the determiner 134 identifies a sensor device 104 included in the association data in the association data storage 125 for each of the air conditioners 101_1 to _3. The determiner 134 determines whether the measurement data including the most recent temperature measured by the identified sensor device 104 is stored in the measurement data storage 124 by making reference to the measurement time included in the measurement data.

When there is a sensor device 104 for which the determiner 134 determined no measurement data including the most recent temperature is stored in the measurement data storage 124, the complementer 135 reads from the measurement data storage 124 measurement data including a temperature measured by that sensor device 104 before a predetermined time. The complementer 135 complements the temperature presented by the read measurement data to calculate a most recent temperature as a control parameter.

The complementer 135 creates control parameter data including the calculated control parameter. In doing so, the complementer 135 makes reference to the association data in the association data storage 125 and identifies the communication address of an air conditioner 101 associated with the sensor device 104 for which the determiner 134 determined no measurement data including the most recent temperature is stored. Then, the complementer 135 further includes the identified communication address in the control parameter data.

When there is a sensor device 104 for which the determiner 134 determined measurement data including the most recent temperature is stored in the measurement data storage 124, the creator 136 creates control parameter data including the most recent temperature. In doing so, the creator 136 further includes the communication address identified, for example, in the same manner as the above-described complementer 135 in the control parameter data.

The control parameter transmitter 129 sends the control parameter data created by the complementer 135 or the creator 136 to the integrated controller 102.

The measurement data receiver 130 receives measurement data from each of the sensor devices 104. The measurement data receiver 130 passes on the received measurement data to the measurement data storage 124. As a result, the measurement data received by the measurement data receiver 130 is stored in the measurement data storage 124 in sequence.

As communication with a sensor device 104 occurs, the communication count updater 131 reads from the communication count storage 126 communication count data including the communication address of the sensor device 104. The communication with a sensor device 104 means, for example, that the measurement data receiver 130 receives measurement data from a sensor device 104. The communication count updater 131 adds one to the communication count included in the read communication count data, and stores the communication count data including the added communication count in the communication count storage 126.

As the communication count data is updated by the communication count updater 131, the remaining charge amount estimator 132 estimates the remaining charge amount of the battery 119 of the sensor device 104 by making reference to the communication count data in the communication count storage 126. For example, the remaining charge amount estimator 132 pre-stores data presenting the charge amount of the battery 119 consumed at one session of communication (charge consumption amount per communication). The remaining charge amount estimator 132 calculates the ratio of the remaining charge amount to the initial charge amount of the unused battery 119 as an estimated value of the remaining charge amount of the battery 119 (an estimated remaining charge amount) based on the product of the charge consumption amount per communication and the number of times of communication.

The sleep time determiner 133 determines the sleep times that make at least two sensor devices 104 run out of battery charge around the same time according to the remaining charge amounts of the batteries 119 estimated by the remaining charge amount estimator 132.

The sleep time is a time period during which the operation mode of a sensor device 104 is kept at a sleep mode. The sleep mode is one of the predetermined operation modes of a sensor device 104 in which power consumption is lower than in the other operation mode (the normal mode).

At least two sensor devices 104 mean that at least two of the sensor devices 104 are connected by the communication line L3. For example, for the wireless master device 103_1, at least two sensor devices 104 are any two or all of the sensor devices 104_1 to _3. Moreover, for example, for the wireless master device 103_2, at least two sensor devices 104 are the sensor devices 104_4 and _5.

Running out of battery charge means that the remaining charge amount of a battery 119 is substantially zero, in other words the battery 119 becomes incapable of supplying enough power for the sensor device 104 to operate normally.

For example, when there is a sensor device 104 of which the estimated remaining battery charge amount is equal to or lower than a threshold, the sleep time of the sensor device 104 is decided so that the sensor device 104 runs out of battery charge around the same time as one or more other sensor devices 104 each having the battery 119 having the highest estimated remaining battery charge amount. In more detail, a sensor device 104 of which the estimated remaining battery charge amount is equal to or lower than a threshold is given a longer sleep time than the one or more other sensor devices 104 having higher estimated remaining battery charge amounts so as to lower the power consumption per unit time and run out of battery charge around the same time.

The sleep time decider 133 sends a setting request that is data for requesting setting of the decided sleep time to the target sensor device 104.

(Functional Configuration of the Sensor Devices 104)

As shown in FIG. 8, the sensor devices 104 comprise a sleep time storage 137 storing sleep time data and a wireless master device address storage 138 storing wireless master device address data.

The sleep time data includes a sleep time set for the sensor device 104 storing that data.

The wireless master device address data includes the communication address of a wireless master device 103 with which the sensor device 104 storing that data communicates via the communication line L3.

As shown in the same figure, the sensor devices 104 further comprise a measurer 139 measuring the temperature and transmitting measurement data including the measured temperature, a reception controller 140 controlling permission and inhibition of reception of data via the communication line L3 and receiving a setting request from the wireless master device 103 while the reception is permitted, a sleep controller 141 effecting the sleep mode according to the sleep time decided by the wireless master device 103, and an awakener 142 waking up the sensor device 104.

The measurer 139 measures the temperature of the target space and creates measurement data including the measured temperature and the communication address of the sensor device 104 in which the measurer 139 itself resides. The measurer 139 sends the measurement data to the communication address presented by the wireless master device address data in the wireless master device address storage 138. After completing the transmission of the measurement data, the measurer 139 outputs to the reception controller 140 a transmission completion signal indicating the transmission completion.

Acquiring the transmission completion signal, the reception controller 140 measures the elapsed time since then and permits reception of data via the communication line L3 until a predetermined reception-permitted time elapses. Receiving a setting request from the wireless master device 103 via the communication line L3 while data reception is permitted, the reception controller 140 passes on sleep time data presenting the sleep time included in the setting request to the sleep time storage 137. As a result, the sleep time storage 137 stores the sleep time data and the sleep time decided by the wireless master device 103 is set in the sensor device 104.

When the reception-permitted time has elapsed since the transmission completion signal was acquired, the reception controller 140 inhibits data reception via the communication line L3. Here, the reception controller 140 may inhibit the reception after passing on the sleep time data without waiting for the reception-permitted time to elapse.

As the reception controller 140 inhibits the reception, the sleep controller 141 controls the operation of the sensor device 104 in the sleep mode until the set sleep time elapses immediately after the inhibition.

In more detail, for example, as the reception controller 140 inhibits the reception, the sleep controller 141 detects the reception being inhibited by the reception controller 140 by means of, for example, a signal acquired from the reception controller 140. Detecting the reception being inhibited, the sleep controller 141 executes a sleep start procedure.

The sleep start procedure includes starting measuring the elapsed time since the detection of the reception being inhibited, withholding some functions so as to reduce the power consumption, and the like. Withholding some functions includes, for example, one or more of the following lowering the clock frequency at which the MPU 107*c* operates below the normal one, stopping the function of the measurer 139, inhibiting reception of data from the inputter 110*c*, inhibiting display by the display 111*c*, and the like.

As the sleep start procedure is executed, the operation mode of the sensor device 104 is changed from the normal mode to the sleep mode. The sleep controller 141 continues to measure the elapsed time and to maintain the sleep mode until the measured elapsed time reaches the set sleep time.

As the elapsed time measured by the sleep controller 141 reaches the set sleep time, the awakener 142 restores the operation mode of the sensor device 104 from the sleep mode to the normal mode.

In more detail, for example, the awakener 142 detects the sleep time having elapsed by acquiring a signal from the sleep controller 141 or the like. Detecting the sleep time having elapsed, the awakener 142 restores the functions withheld by the sleep controller 141. With this wake-up procedure being executed, the operation mode of the sensor device 104 returns to the normal mode.

Here, the functions of the integrated controller 102, the wireless master devices 103, and the sensor devices 104 may each be realized by dedicated hardware, a general-purpose computer executing software programs, or the like. When the function of the sensor devices 104 is realized by a general-purpose computer, the sensor 112 may be connected to the computer.

The configuration of the air conditioner control system 100 according to this embodiment is described above. Operation of the air conditioner control system 100 will be described hereafter.

(Operation of the Air Conditioner Control System 100)

Figure 9:
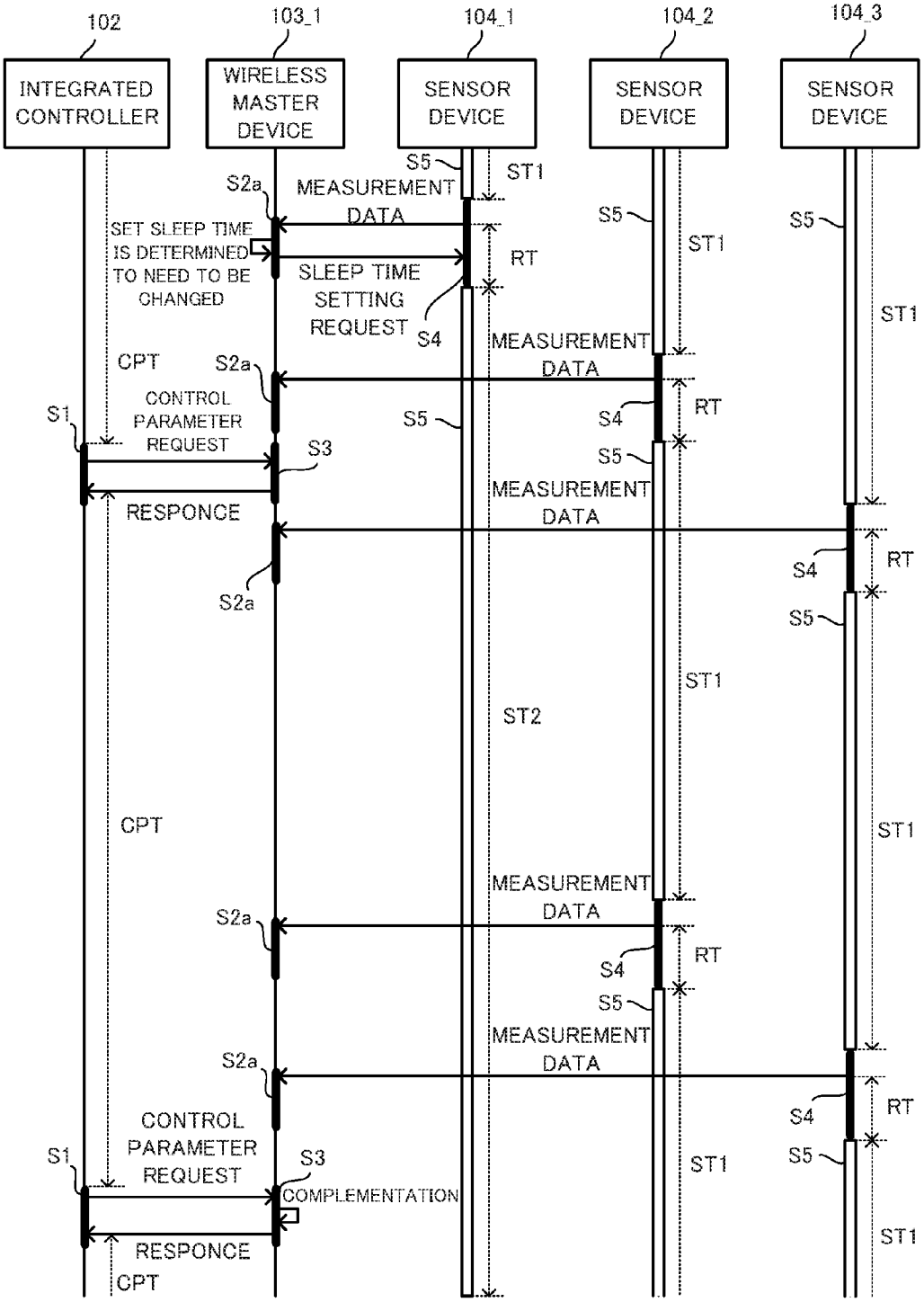
FIG. 9 is a time chart for explaining the operation of the air conditioner control system according to Embodiment 1.

Operation of the air conditioner control system 100 will be described with reference to the sequence chart of FIG. 9 showing exemplary operations regarding the integrated controller 102, the wireless master device 103_1, and the sensor devices 104_1 to _3. The following explanation will be made generally in chronological order from the top to the bottom of the same figure.

In the case shown in the same figure, the following assumption is made. A sleep time ST1 is set for each of the sensor devices 104_1 to _'as the initial value. A reception-permitted time RT is set for each of the sensor devices 104_1 to _3, and a control parameter acquisition time CPT is set for the integrated controller 102. The threshold of the estimated remaining battery charge amount for changing the sleep time is 30 (%). The remaining charge amount of the battery 119 of the sensor device 104_1 is 30 (%) at the beginning of the processing shown in the same figure, and the remaining charge amount of the battery 119 of the sensor device 104_1 does not fall below 30 (%) during the processing shown in the same figure.

The sensor device 104_1 ends a sleep mode procedure (Step S5) and starts a normal mode procedure (Step S4). Measurement data is sent from the sensor device 104_1 to the wireless master device 103_1.

Receiving the measurement data from the sensor device 104_1, the wireless master device 103_1 starts a data collection control procedure (Step S2*a*) with the sensor device 104_1. If the remaining charge amount of the battery 119 of the sensor device 104_1 is 30 (%) as mentioned above, the estimated remaining battery charge amount is estimated to be 30 (%). Since the estimated remaining battery charge amount is equal to or lower than the threshold (30%), the wireless master device 103_1 determines that the set sleep time of the sensor device 104_1 needs to be changed. The sleep time of the sensor device 104_1 is decided to be a sleep time ST2 that is longer than the initial sleep time ST1. A sleep time setting request including the sleep time ST2 is sent from the wireless master device 103_1 to the sensor device 104_1. Then, the wireless master device 103_1 ends the data collection control procedure (Step S2*a*) with the sensor device 104_1.

Receiving the sleep time setting request while the reception is permitted, the sensor device 104_1 ends the normal mode procedure (Step S4) of the sensor device 104_1 and starts a sleep mode procedure (Step S5). From then on, the sensor device 104_1 continues to execute the sleep mode procedure (Step S5) and as a result, maintains the sleep mode until the sleep time ST2 elapses. The sensor device 104_1 does not execute the normal mode procedure (Step S4) in the time period shown in the same figure.

The sensor device 104_2 ends the sleep mode procedure (Step S5) and starts a first normal mode procedure (Step S4). Measurement data is sent from the sensor device 104_2 to the wireless master device 103_1.

Receiving the measurement data from the sensor device 104_2, the wireless master device 103_1 starts a first data collection control procedure (Step S2*a*) with the sensor device 104_2. The remaining charge amount of the battery 119 of the sensor device 104_2 is higher than 30 (%) as mentioned above; therefore, there is no need to change the sleep time. The wireless master device 103_1 ends the first data collection procedure (Step S2*a*) with the sensor device 104_2.

Receiving no sleep time setting request, the sensor device 104_2 ends the first normal mode procedure (Step S4) and starts and continues to execute the sleep mode procedure (Step S5) after the reception-permitted time RT elapses.

The integrated controller 102 starts a first individual air conditioner control procedure (Step S1). A control parameter request is sent to the wireless master device 103_1.

Receiving the control parameter request, the wireless master device 103_1 starts a first control parameter transmission procedure (Step S3). The wireless master device 103_1 has received and stored measurement data including the most recent temperature for each of the sensor devices 104_1 to _3. Here, it is assumed that for the sensor device 104_3, measurement data sent in a not-shown normal mode procedure (Step S4) includes the most recent temperature. The wireless master device 103_1 creates and sends to the integrated controller 102 control parameter data including the measured most recent temperature for each of the sensor devices 104_1 to _3 as a response to the control parameter request. The wireless master device 103_1 ends the first control parameter transmission operation (Step S3).

Receiving the control parameter data from the wireless master device 103_1, the integrated controller 102 stores the control parameter data. The integrated controller 102 makes a control parameter request also for the not-shown wireless master device 103_2, receives the control parameter data in response, and stores the control parameter data. The integrated controller 102 controls the operation of each of the air conditioners 101_1 to _5 based on the received control parameter data. Then, the integrated controller 102 ends the first individual air conditioner control procedure (Step S1). Each of the air conditioners 101_1 to _5 operates according to the control of the integrated controller 102 so as to adjust the temperature of the target space.

The sensor device 104_3 ends the sleep mode procedure (Step S5) and starts a first normal mode procedure (Step S4). Measurement data is sent from the sensor device 104_2 to the wireless master device 103_1.

Receiving the measurement data from the sensor device 104_3, the wireless master device 103_1 starts a first data collection control procedure (Step S2*a*) with the sensor device 104_3. The remaining charge amount of the battery 119 of the sensor device 104_3 is higher than 30 (%) as mentioned above; therefore, there is no need to change the sleep time. The wireless master device 103_1 ends the first data collection procedure (Step S2*a*) with the sensor device 104_3.

Receiving no sleep time setting request, the sensor device 104_3 ends the first normal mode procedure (Step S4) and starts and continues to execute the sleep mode procedure (Step S5) after the reception-permitted time RT elapses.

After the sleep time ST1 elapses since the sensor device 104_2 started the sleep mode procedure (Step S5), the sensor device 104_2 ends the sleep mode procedure (Step S5) and starts a second normal mode procedure (Step S4). Measurement data is sent from the sensor device 104_2 to the wireless master device 103_1.

Receiving the measurement data from the sensor device 104_2, the wireless master device 103_1 starts a second data collection control procedure (Step S2*a*) with the sensor device 104_2. The remaining charge amount of the battery 119 of the sensor device 104_2 is higher than 30 (%) as mentioned above; therefore, there is no need to change the sleep time. The wireless master device 103_1 ends the second data collection control procedure (Step S2*a*) with the sensor device 104_2.

Receiving no sleep time setting request, the sensor device 104_2 ends the second normal mode procedure (Step S4) and starts and continues to execute the sleep mode procedure (Step S5) after the reception-permitted time RT elapses.

After the sleep time ST1 elapses since the sensor device 104_3 started the sleep mode procedure (Step S5), the sensor device 104_3 ends the sleep mode procedure (Step S5) and starts a second normal mode procedure (Step S4). Measurement data is sent from the sensor device 104_3 to the wireless master device 103_1.

Receiving the measurement data from the sensor device 104_3, the wireless master device 103_1 starts a second data collection control procedure (Step S2*a*) with the sensor device 104_3. The remaining charge amount of the battery 119 of the sensor device 104_3 is higher than 30 (%) as mentioned above; therefore, there is no need to change the sleep time. The wireless master device 103_1 ends the second data collection control procedure (Step S2*a*) with the sensor device 104_3.

Receiving no sleep time setting request, the sensor device 104_3 ends the second normal mode procedure (Step S4) and starts and continues to execute the sleep mode procedure (Step S5) after the reception-permitted time RT elapses.

After the control parameter acquisition time CPT elapses since the control parameter data was received as a response in the first individual air conditioner control procedure (Step S1), the integrated controller 102 starts a second individual air conditioner control procedure (Step S1). A control parameter request is sent to the wireless master device 103_1.

Receiving the control parameter request, the wireless master device 103_1 starts a second control parameter transmission procedure (Step S3). Since the sensor device 104_1 is in the sleep mode since the first control parameter transmission procedure ended, the wireless master device 103_1 has received no measurement data including the most recent temperature from the sensor device 104_1 and therefore stored no measurement data including the most recent temperature for the sensor device 104_1. The wireless master device 103_1 executes a complementation procedure to calculate a most recent temperature and creates control parameter data including the calculated temperature. On the other hand, measurement data including the actually measured most recent temperature was received and stored for each of the sensor devices 104_2 and _3. The wireless master device 103_1 creates control parameter data including those actually measured most recent temperatures. The wireless master device 103_1 sends to the integrated controller 102 the control parameter data created for each of the sensor devices 104_1 to _3 as a response to the control parameter request. The wireless master device 103_1 ends the second control parameter transmission procedure (Step S3).

Receiving the control parameter data from the wireless master device 103_1, the integrated controller 102 stores the received control parameter data. The integrated controller 102 makes a control parameter request also for the not-shown wireless master device 103_2, receives control parameter data in response, and stores the received control parameter data. The integrated controller 102 controls the operation of each of the air conditioners 101_1 to _5 based on the received control parameter data. Then, the integrated controller 102 ends the second individual air conditioner control procedure (Step S1). Each of the air conditioners 101_1 to _5 operates according to the control of the integrated controller 102 to adjust the temperature of the target space.

(Operation of the Integrated Controller 102)

Figure 10:
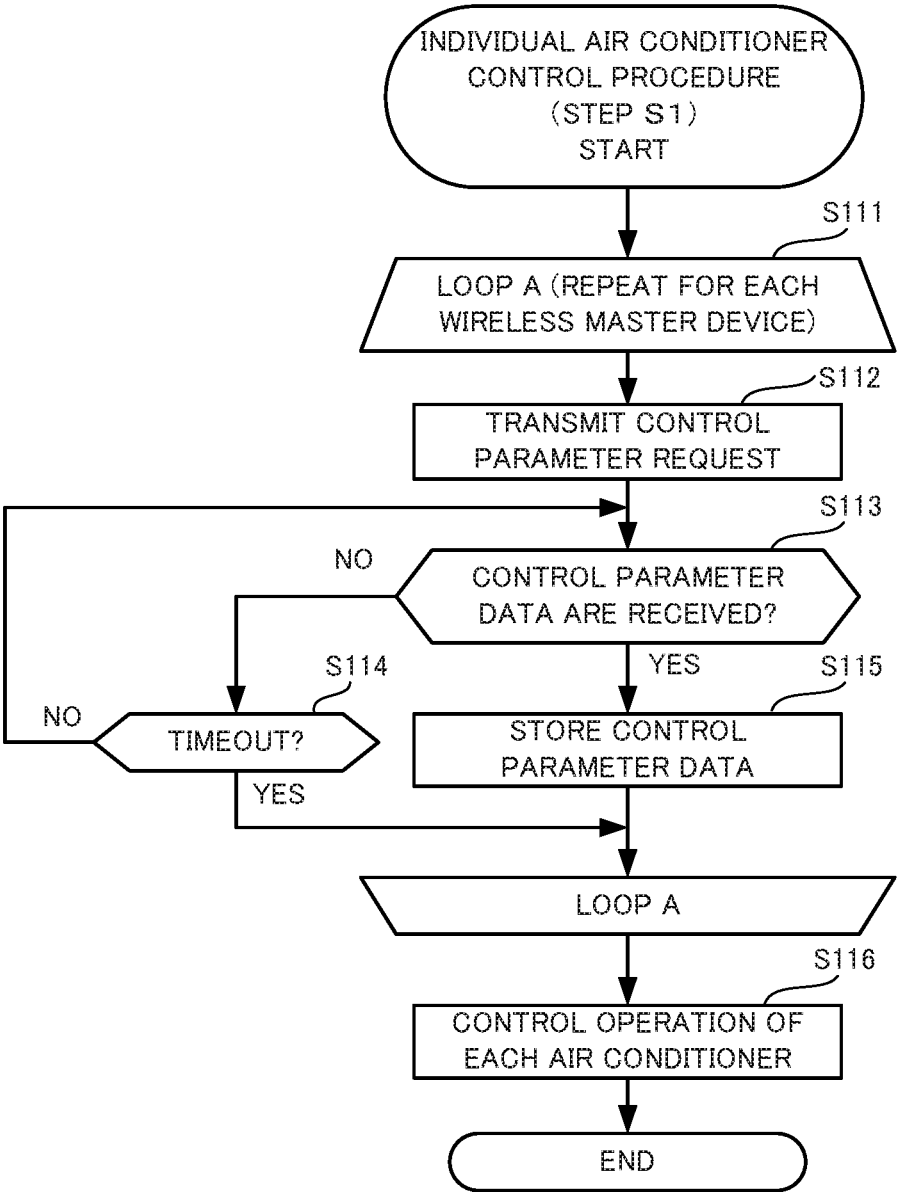
FIG. 10 is a flowchart showing the process flow of the individual air conditioner control procedure executed by the integrated controller according to Embodiment 1.

The integrated controller 102 executes the individual air conditioner control procedure (Step S1) shown in FIG. 10 when, for example, the control parameter acquisition time elapses since receiving the last control parameter data as a response to a control parameter request.

As shown in the same figure, the control parameter request transmitter 121, the control parameter receiver 122, and the control parameter storage 120 execute Steps S112 to S115 in sequence for each of the wireless master devices 103_1 and _2 (LOOP A; Step S111).

The control parameter request transmitter 121 sends a control parameter request to the wireless master device 103_1 as a processing target via the communication line L2 (Step S112).

Receiving a notice of a control parameter request being sent from the control parameter request transmitter 121, the control parameter receiver 122 measures the elapsed time since then. In parallel to this, the control parameter receiver 122 determines whether control parameter data is received from the wireless master device 103_1 (Step S113).

If no control parameter data is received (Step S113; NO), the control parameter receiver 122 determines whether the time-out has occurred (Step S114). If a predetermined time has not elapsed since the start of measuring the elapsed time, the time-out has not occurred (Step S114; NO), and the control parameter receiver 122 repeats Steps S113 and S114. If a predetermined time has elapsed since the start of measuring the elapsed time, the time-out has occurred (Step S114; YES), and the control parameter receiver 122 ends the LOOP A (Step S111) for the wireless master device 103_1 as a processing target. Then, the control parameter request transmitter 121, the control parameter receiver 122, and the control parameter storage 120 executes the LOOP A (Step S111) for the wireless master device 103_2 as a processing target.

If control parameter data is received (Step S113; YES), the control parameter receiver 122 passes on the received control parameter data to the control parameter storage 120. The control parameter storage 120 stores the control parameter data acquired from the control parameter receiver 122 (Step S115), and ends the LOOP A (Step S111) for the wireless master device 103_1 as a processing target. Then, the control parameter request transmitter 121, the control parameter receiver 122, and the control parameter storage 120 executes the LOOP A (Step S111) for the wireless master device 103_2 as a processing target.

The air conditioner controller 123 controls the operation of each of the air conditioners 101_1 to _5 (Step S116), and ends the individual air conditioner control procedure.

In more detail, after the LOOP A (Step S111) for all wireless master devices 103_1 and _2 ends, for example receiving a notice from the control parameter receiver 122 or the control parameter storage 120, the air conditioner controller 123 acquires from the control parameter storage 120 control parameter data including the address of each of the air conditioners 101_1 to _5. The air conditioner controller 123 sends to the communication address included in the acquired control parameter data control data for controlling the operation of an air conditioner 101 indicated by that communication address.

For example, when control parameter data including the address of the air conditioner 101_1 are acquired, the air conditioner controller 123 compares a target value preset for the air conditioner 101_1 with the control parameter included in the control parameter data. The air conditioner controller 123 creates and sends to the air conditioner 101_1 control data changing the operation of the air conditioner 101_1 according to the comparison result. As a result, the air conditioner 101_1 operates according to the control data. Subsequently, the air conditioner controller 123 acquires control parameter data including the address of each of the air conditioners 101_2 to _5 in sequence, similarly creates control data according to the result of comparison between a target value and the control parameter, and sends the created control data to each of the air conditioners 101_2 to _5.

As the individual air conditioner control procedure is executed, each of the air conditioners 101 can be operated to adjust the temperature of the target space to a predetermined target value. As a result, it is possible to condition the target space to a proper temperature.

(Operation of the Wireless Master Devices 103: Data Collection Control Procedure)

Figure 11:
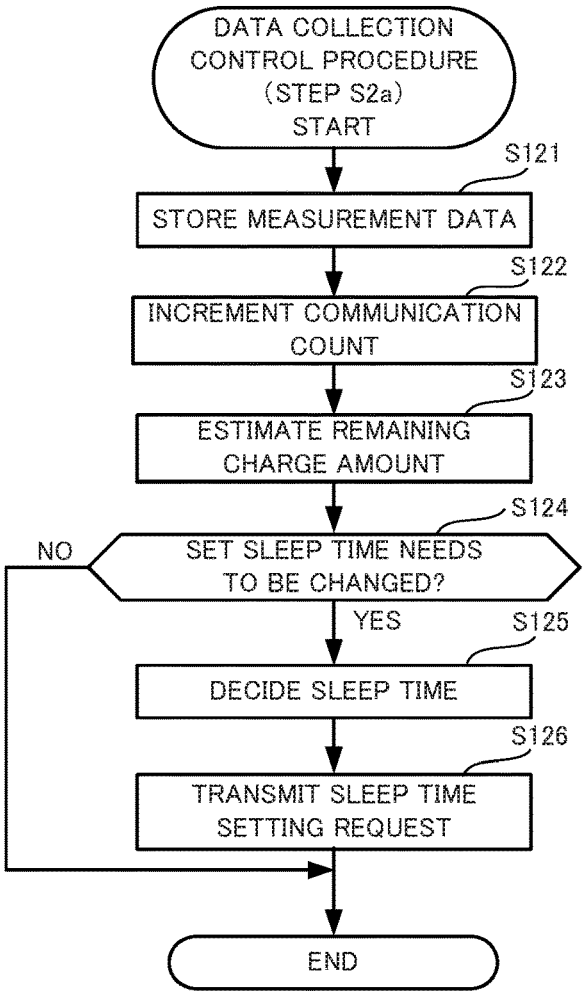
FIG. 11 is a flowchart showing the process flow of the data collection control procedure executed by a wireless master device according to Embodiment 1.

As the measurement data receiver 130 receives measurement data from the sensor devices 104, the wireless master devices 103 each execute the data collection control procedure (Step S2*a*) shown in FIG. 11. Here, a case in which the wireless master device 103_1 executes the data collection control procedure (Step S2*a*) is described.

The measurement data receiver 130 passes on the measurement data received from the sensor device 104_1 to the measurement data storage 124. The measurement data storage 124 stores the acquired measurement data (Step S121).

Receiving a notice from the measurement data receiver 130 having received the measurement data, the communication count updater 131 reads from the communication count storage 126 the communication count data of the sensor device 104_1 that is the transmission source of the measurement data. The communication count updater 131 increments the communication count presented by the read communication count data (Step S122). The communication count updater 131 passes on the communication count data presenting the incremented communication count to the communication count storage 126. The communication count storage 126 stores the acquired communication count data. As a result, the communication count data of the sensor device 104_1 stored in the communication count storage 126 is updated.

Receiving a notice from the communication count updater 131 having updated the communication count data, the remaining charge amount estimator 132 estimates the remaining charge amount of the battery 119 of each of the sensor devices 104_1 to _3 based on the communication count data of each of the sensor devices 104_1 to _3 stored in the communication count storage 126 (Step S123).

The sleep time decider 133 determines whether the set sleep time of the sensor device 104_1 needs to be changed based on the remaining charge amount of the battery 119 estimated by the remaining charge amount estimator 132 (Step S124).

For example, the sleep time decider 133 compares the estimated remaining battery charge amount that is the estimated value of the remaining charge amount of the battery 119 of the sensor device 104_1 with a threshold. If the estimated remaining battery charge amount of the sensor device 104_1 is not equal to or lower than the threshold, the sleep time decider 133 determines that the set sleep time of the sensor device 104_1 does not need to be changed (Step S124; NO), and ends the data collection control procedure (Step S2*a*).

If the estimated remaining battery charge amount of the sensor device 104_1 is equal to or lower than the threshold, the sleep time decider 133 determines that the set sleep time of the sensor device 104_1 needs to be changed (Step S124; YES).

Figure 12:
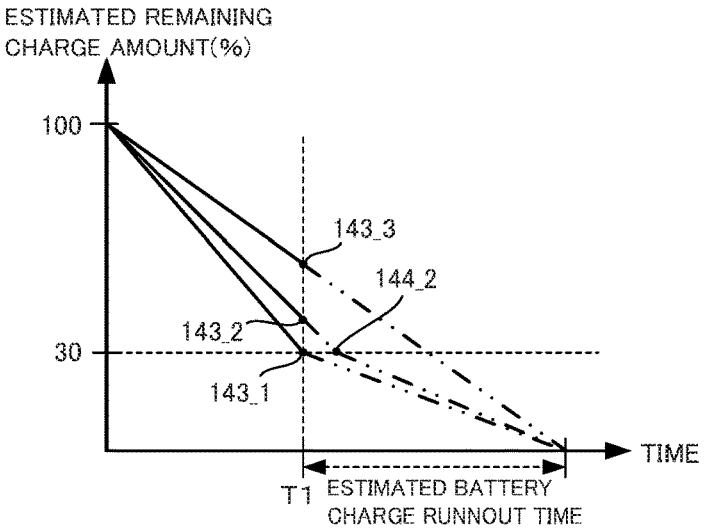
FIG. 12 is a graphical representation for explaining an exemplary method of determining the sleep time.

For example, as shown in FIG. 12, it is assumed that an estimated remaining battery charge amount 143_1 of the sensor device 104_1 estimated in Step S123 is 30 (%) at a time T1, and the threshold for the determination in Step S124 is 30 (%). Then, the estimated remaining battery charge amount 143_1 of the sensor device 104_1 is equal to or lower than the threshold, whereby the sleep time decider 133 determines that the set sleep time of the sensor device 104_1 needs to be changed.

If the set sleep time needs to be changed (Step S124; YES), the sleep time decider 133 determines a sleep time to set for the sensor device 104_1 (Step S125).

For example, it is assumed in the case shown in FIG. 12 that the sensor device 104_2 has an estimated remaining battery charge amount 143_2 at the time T1 and the sensor device 104_3 has an estimated remaining battery charge amount 143_3 at the time T1. At this point, the battery 119 of the sensor device 104_3 has the highest estimated remaining battery charge amount.

The sleep time decider 133 calculates a time period in which the sensor device 104_3 runs out of battery from the time T1 (an estimated battery runout time) on the assumption that the remaining charge amount of the battery 119 decreases at the same rate per unit time as from 100% to the time T1.

The sleep time decider 133 calculates a sleep time that makes the battery 119 of the sensor device 104_1 have an estimated remaining battery charge amount of zero in the estimated battery runout time.

In more detail, for example, such a sleep time is calculated that the number of times of communication with the sensor device 104_1 during the estimated battery runout time is equal to the number of times obtained by dividing the estimated remaining battery charge amount at the time T1 of the battery 119 included in sensor device 104_1 by the charge consumption amount per communication. The sleep time decider 133 decides the calculated sleep time to be the sleep time of the sensor device 104_1.

Then, it is assumed that the estimated remaining battery charge amount of each of the sensor device 104_1 to _3 gradually decreases with time, for example, as shown in the same figure. Then, it is assumed that when the wireless master device 103_1 executes the data collection control procedure (Step S2*a*), the estimated remaining battery charge amount of the battery 119 of the sensor device 104_2 is 30% (an estimated remaining battery charge amount 144_2 in the same figure). Also in such a case, the estimated remaining battery charge amount of the sensor device 104_2 is equal to or lower than the threshold 30%, whereby the sleep time decider 133 decides the sleep time of the sensor device 104_2.

With reference to FIG. 11 again, a case of the sensor device 104_1 is described. The sleep time decider 133 sends to the sensor device 104_1 a sleep time setting request including the decided sleep time of the sensor device 104_1 (Step S126), and ends the data collection control procedure (Step S2*a*).

(Operation of the Wireless Master Devices 103: Control Parameter Transmission Procedure)

Figure 13:
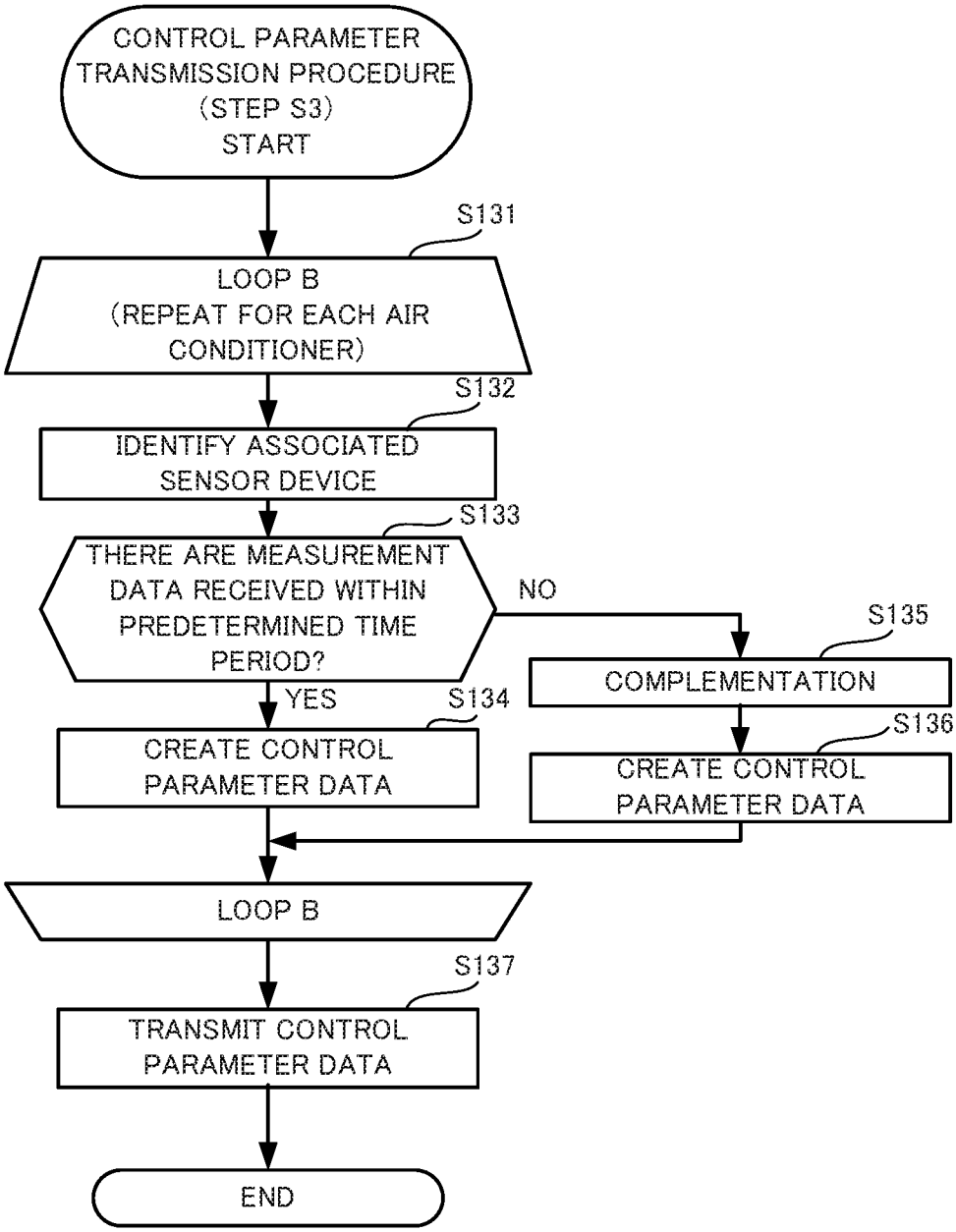
FIG. 13 is a flowchart showing the process flow of the control parameter transmission procedure executed by a wireless master device according to Embodiment 1.

As the control parameter request receiver 127 receives a control parameter request from the integrated controller 102, the wireless master devices 103 each execute the control parameter transmission procedure (Step S3) shown in FIG. 13. Here, a case in which the wireless master device 103_1 executes the control parameter transmission procedure (Step S3) will be described.

The control parameter creator 128 executes Steps S132 to S136 for each of the air conditioners 101_1 to _3 included in the association data stored in the association data storage 125 (LOOP B; Step S131).

The determiner 134 makes reference to the association data in the association data storage 125 and identifies, for example, the sensor device 104_1 associated with the air conditioner 101_1 (Step S132). In this embodiment, as described above, the sensor device 104_1 is associated with the air conditioner 101_1 in the association data. Therefore, the determiner 134 identifies the sensor device 104_1 when the processing target air conditioner 101 in the LOOP B (Step 5131) is the air conditioner 101$_{_L\ 1}$.

The determiner 134 determines whether there is any measurement data of the sensor device 104_1 identified in Step S132 that includes the most recent temperature in the measurement data stored in the measurement data storage 124 (Step S133). For example, the determiner 134 extracts the measurement data including a measurement time closest to the current time in the measurement data of the sensor device 104_1. The determiner 134 determines whether the measurement time included in the extracted measurement data falls within a predetermined range from the current time measured by the timer 109.

If there is any measurement data including the most recent temperature (Step S133; YES), the creator 136 creates control parameter data including the most recent temperature (Step S134). In more detail, the creator 136 creates control parameter data further including the communication address of the air conditioner 101_1 that is the processing target in the LOOP B (Step S131).

If there is no measurement data including the most recent temperature (Step S133; NO), the complementer 135 reads from the measurement data storage 124 the measurement data including a temperature measured before a predetermined time by the sensor device 104_1 that is the transmission source of the measurement data. The complementer 135 complements the temperature included in the read measurement data (Step S135). As a result, the complementer 135 calculates, for example, the current temperature as a control parameter.

Here, a case of calculating a temperature at the current time T1 by complementation with the method according to this embodiment is described with reference to FIG. 14.

As shown in the same figure, it is assumed that the sensor device 104_1 takes measurements at times the T2, T3, T4, and T5 at time intervals of ΔT. It is assumed that the measurement data storage 124 stores the measurement data including temperatures 145, 146, and 147 measured at the times T2, T3, and T4, respectively, but does not store the measurement data including the most recent temperature 148 measured at the time T5. Since the measurement data at the time T5 is missing, it is determined in Step S133 that there are no measurement data including a temperature measured within a predetermined time range from the time T1 (the most recent temperature) in the measurement data of the sensor device 104_1 stored in the measurement data storage 124 (Step S133; NO).

The complementer 135 reads from the measurement data storage 124 three measurement data in sequence starting with those of which the measurement time is closest to the current time T1. The complementer 135 obtains an approximate function 149 presenting the relation between times and measured temperatures based on the temperatures 145 to 147 included in the read measurement data. The complementer 135 substitutes the current time T1 in the approximate function 149 to calculate a temperature 150 at the time T1 as a control parameter.

Here, the number of measurement data to read from the measurement data storage 124 for complementation is not limited to three, and may be determined as appropriate according to the approximate function used for complementation. Moreover, the approximate function 149 is calculated by the complementer 135. However, for example, each time the measurer 139 receives measurement data, the measurer 139 may calculate the approximate function 149 by making reference to the received measurement data and the measurement data in the measurement data storage 124. In such a case, the measurer 139 may store in the measurement data storage 124 the approximate function data presenting the calculated approximate function 149 along with the communication address of a sensor device 104 that is the transmission source of the received measurement data.

The complementer 135 creates control parameter data including the control parameter calculated by executing Step S135 (Step S136). In more detail, the complementer 135 creates control parameter data further including the communication address of the air conditioner 101_1 like the control parameter data created by the creator 136 in the Step S134.

Then, the control parameter creator 128 ends the LOOP B (Step S131) for the air conditioner 101_1 as a processing target. The control parameter creator 128 executes Steps S132 to S136 (LOOP B; Step S131), for example, for the air conditioner 101_2 and the air conditioner 101_3 as processing targets in sequence.

As the LOOP B (Step S131) ends, the control parameter transmitter 129 sends to the integrated controller 102 the control parameter data created by the complementer 135 and the creator 136 (Step S137). Then, the control parameter transmitter 129 ends the control parameter transmission procedure (Step S3).

(Operation of the Sensor Devices 104: Normal Mode Procedure)

Figure 15:
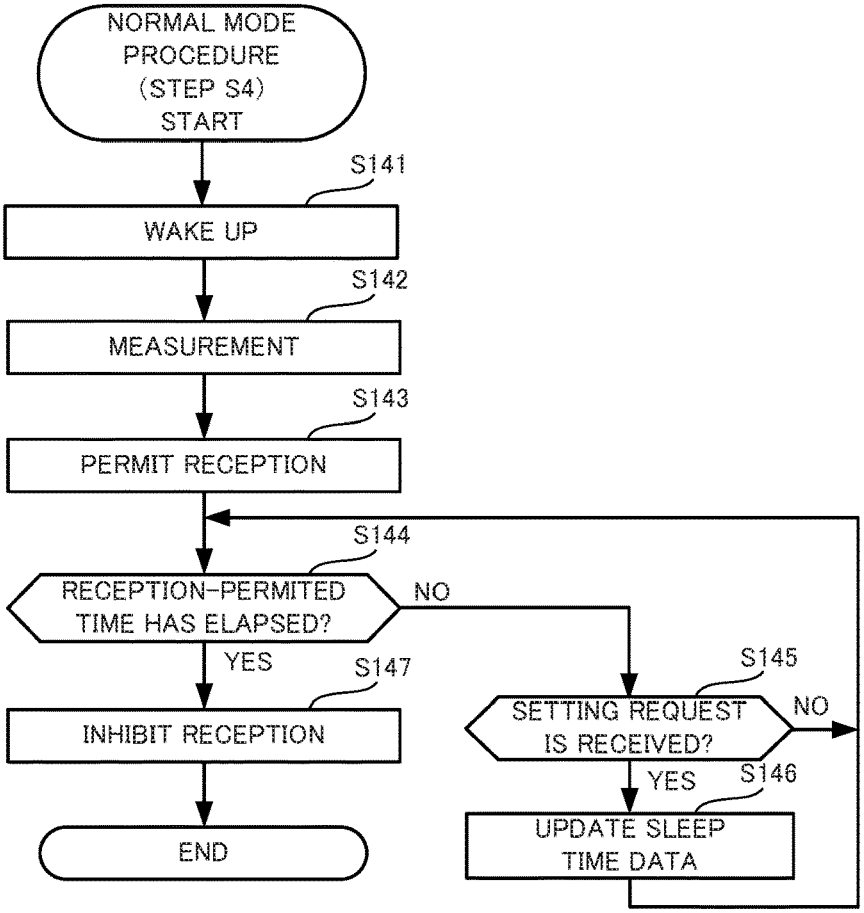
FIG. 15 is a flowchart showing the process flow of the normal mode procedure executed by a sensor device according to Embodiment 1.

As the sleep time elapses since the operation mode is changed to the sleep mode, the sensor devices 104 each execute the normal mode procedure (Step S4) shown in FIG. 15.

As shown in the same figure, detecting that the sleep time has elapsed by acquiring a signal from the sleep controller 141 or the like, the awakener 142 wakes up the sensor device 104 (Step S141).

The measurer 139 measures the temperature of the target space and creates measurement data including the measured temperature and the communication address of the sensor device 104. The measurer 139 sends the created measurement data to the communication address presented by the wireless master device address data stored in the wireless master device address storage 138 (Step S142). For example, in the case of the sensor device 104_1, the transmission destination is the wireless master device 103_1.

Acquiring a transmission completion signal from the measurer 139 having completely transmitted the measurement data, the reception controller 140 starts measuring the elapsed time since the time of acquisition, and permits reception of data via the communication line L3 (Step S143).

The reception controller 140 determines whether the reception-permitted time has elapsed since the transmission completion signal was acquired (Step S144). If the reception-permitted time has not elapsed (Step S144; NO), the reception controller 140 determines whether a sleep time setting request is received from the wireless master device 103 (Step S145). If determining that no sleep time setting request is received (Step S145; NO), the reception controller 140 executes Step S144.

If determining that a sleep time setting request is received (Step S145; YES), the reception controller 140 creates and passes on to the sleep time storage 137 sleep time data including a sleep time included in the received sleep time setting request. The sleep time storage 137 stores the acquired sleep time data so as to update the sleep time data (Step S146).

If the reception-permitted time has elapsed (Step S144; YES), the reception controller 140 inhibits reception of data via the communication line L3 (Step S147), and ends the normal mode procedure (Step S4).

(Operation of the Sensor Devices 104: Sleep Mode Procedure)

Figure 16:
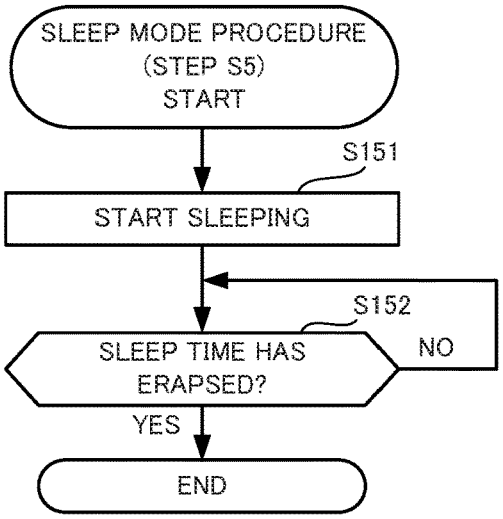
FIG. 16 is a flowchart showing the process flow of the sleep mode procedure executed by a sensor device according to Embodiment 1.

As the reception controller 140 inhibits reception of data via the communication line L3, the sensor devices 104 each execute the sleep mode procedure (Step S5) shown in FIG. 16.

As shown in the same figure, detecting inhibition of reception by acquiring a signal from the reception controller 140 or the like, the sleep controller 141 executes the sleep start procedure (Step S151). The sleep start procedure includes starting to measure the elapsed time as described above.

The sleep controller 141 determines whether the sleep time has elapsed (Step S152).

If the measured elapsed time is less than the sleep time, the sleep controller 141 determines that the sleep time has not elapsed (Step S152; NO), and continues the sleep mode operation. In other words, the sleep controller 141 continues to measure the elapsed time and maintains the withheld functions as withheld in the sleep start procedure. With the operation mode of the sensor device 104 being changed to the sleep mode as described above, the battery 119 of the sensor device 104 is consumed less than in the normal mode operation.

When the measured elapsed time becomes equal to the sleep time, the sleep controller 141 determines that the sleep time has elapsed (Step S152; YES) and ends the sleep mode procedure (Step S5). At this point, the sleep controller 141 may, for example, output to the awakener 142 a signal to execute the wake-up procedure (Step S141).

As described above, according to this embodiment, a sleep time that makes at least two sensor devices 104 run out of battery charge is set according to the remaining battery charge amount of each of the sensor devices 104. Then, the sensor device 104 will be in the sleep mode in which power consumption is lower than in the normal mode according to the set sleep time. As a result, the batteries 119 of two or more sensor devices 104 can be replaced around the same time. Therefore, it is possible to reduce maintenance-related labor accompanying exhaustion of the batteries 119.

According to this embodiment, the wireless master devices 103 estimate the remaining charge amounts of the batteries 119 of the sensor devices 104. As a result, the sensor devices 104 do not need to measure the remaining charge amount of the battery 119 and notify the wireless master device 103 of the remaining charge amount. Therefore, it is possible to reduce exhaustion of the batteries 119 accompanying measurement and notification of the remaining battery charge amounts.

According to this embodiment, when no measurement data including the most recent temperature are received or stored, a temperature obtained by complementation is used as a control parameter for creating the control parameter data. As a result, the air conditioner 101 can be controlled based on a control parameter presenting a temperature relatively close to the actual measurement value even if measurement data including an actual temperature measurement value is missing because a prolonged sleep time is set. Therefore, it is possible to prevent the target space from being less comfortable in connection with missing measurement data.

According to this embodiment, the air conditioners 101 and the sensor devices 104 are associated and multiple air conditioners 101 are controlled with control parameter data created for each of them. As a result, each air conditioner 101 can be controlled with a control parameter suitable for each air conditioner 101. Therefore, it is possible to make the target space more comfortable.

Embodiment 1 of the present disclosure is described above. Embodiment 1 may be modified as follows.

(Modified Embodiment 1)

The number of times of communication presented by the communication count data is an example of the communication history for the remaining charge amount estimator 132 to estimate the remaining charge amount of the battery 119. The communication history may be, for example, the communication time with each of the sensor devices 104. In other words, the communication count storage 126 is an exemplary communication history storage storing communication history data including the communication history. The communication count updater 131 is an exemplary communication history updater updating, as the measurement data receiver 130 communicates with a sensor device 104, communication history data presenting the communication history with the communicated sensor device 104.

(Modified Embodiment 2)

In Embodiment 1, when the estimated remaining battery charge amount of a sensor device 104 becomes equal to or lower than a threshold, the sleep time of the sensor device 104 is decided. However, the sleep time may be decided based on the estimated remaining battery charge amount of the battery 119 of each of the sensor devices 104 constantly, for example, each time measurement data is received from any of the sensor devices 104. As a result, it is possible to make the sensor devices 104 run out of battery charge more definitely around the same time.

(Modified Embodiment 3)

The estimated remaining battery charge amount is an example of the remaining battery charge amount of each sensor device 104. The actually measured remaining battery charge amount may be used in place of the estimated remaining battery charge amount. In such a case, for example, the wireless master devices 103 do not comprise the remaining charge amount estimator 132, and the sensor devices 104 each measure the remaining charge amount of their own battery 119 and send measured remaining charge amount data to the wireless master device 103 along with the measurement data. As a result, the wireless master devices 103 can set a sleep time according to the actually measured remaining charge amount of the battery 119 presented by each of the received remaining charge amount data, whereby it is possible to make the sensor devices 104 run out of battery charge more definitely around the same time.

Embodiment 2

In this embodiment, a case in which the wireless master devices obtain a most recent temperature by complementation with a different method from Embodiment 1 will be described.

Figure 17:
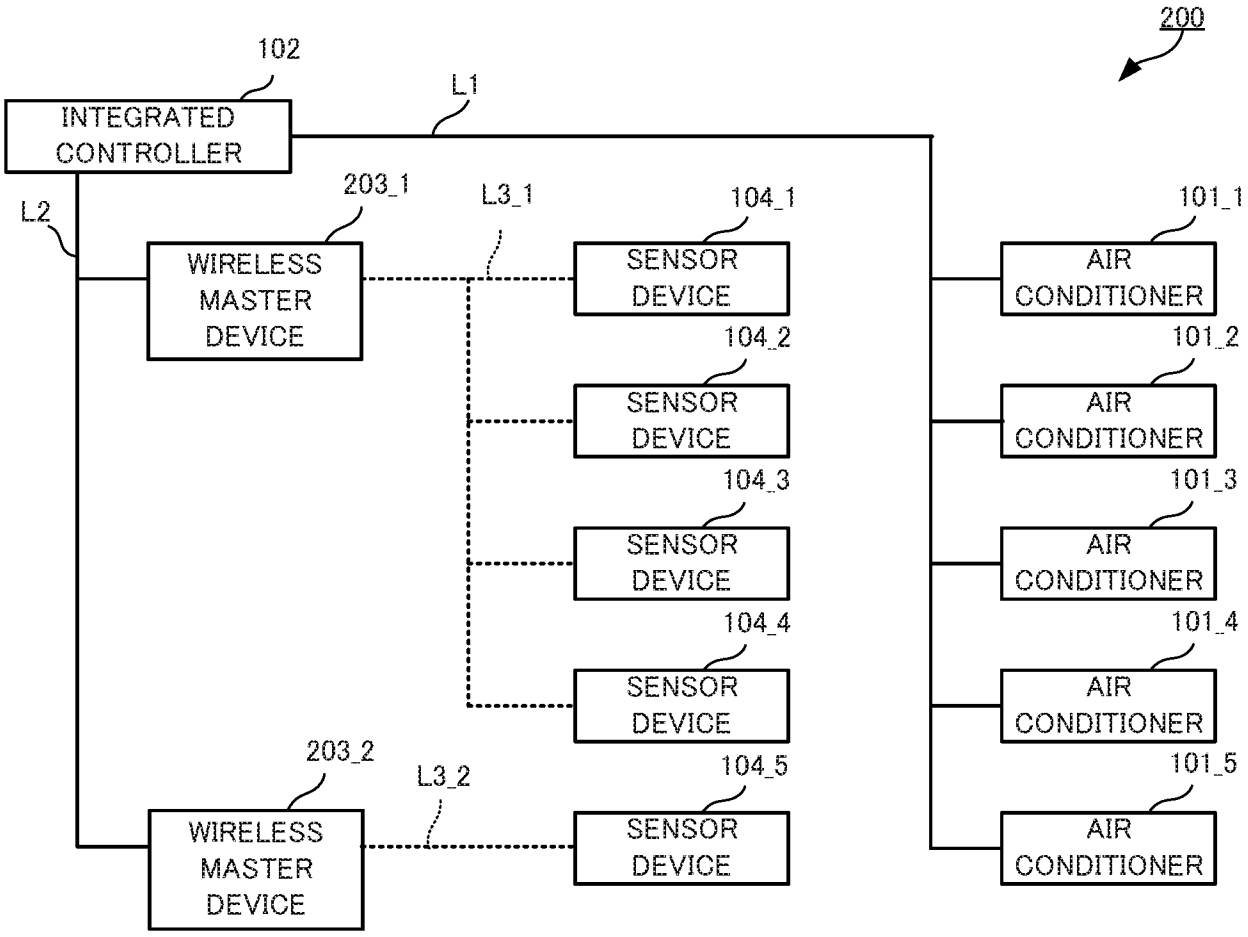
FIG. 17 is a diagram showing the configuration of the air conditioner control system according to Embodiment 2 of the present disclosure.

An air conditioner control system 200 according to this embodiment comprises, as shown in FIG. 17, wireless master devices 203 (203_1 and 203_2) that are different in functional configuration from the wireless master devices 103 in Embodiment 1.

Figure 18:
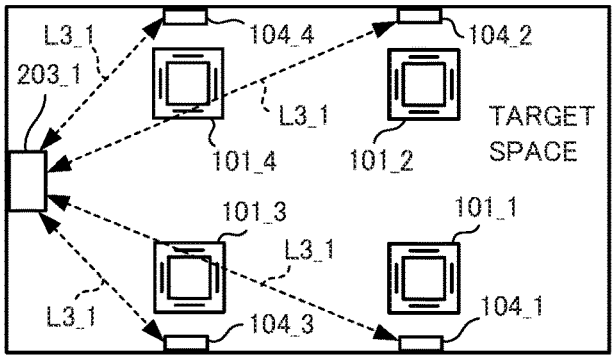
FIG. 18 is an illustration showing an exemplary positional relationship among air conditioners, a wireless master device, and sensor devices in a target space according to Embodiment 2.

Moreover, as shown in FIG. 18, when the air conditioners 101_1 to _4 condition the same target space, sensor devices 104_1 to 4 are installed near the air conditioners 101_1 to _4, respectively. In other words, in this embodiment, the sensor devices 104_1 to _4 are associated with the air conditioners 101_1 to _4, respectively, and wirelessly communicate with the wireless master device 203_1 via the communication line L3. Here, although not shown, a sensor device 104_5 is associated with an air conditioner 101 5 and wirelessly communicate with the wireless master device 203_2 via the communication line L3.

Figure 19:
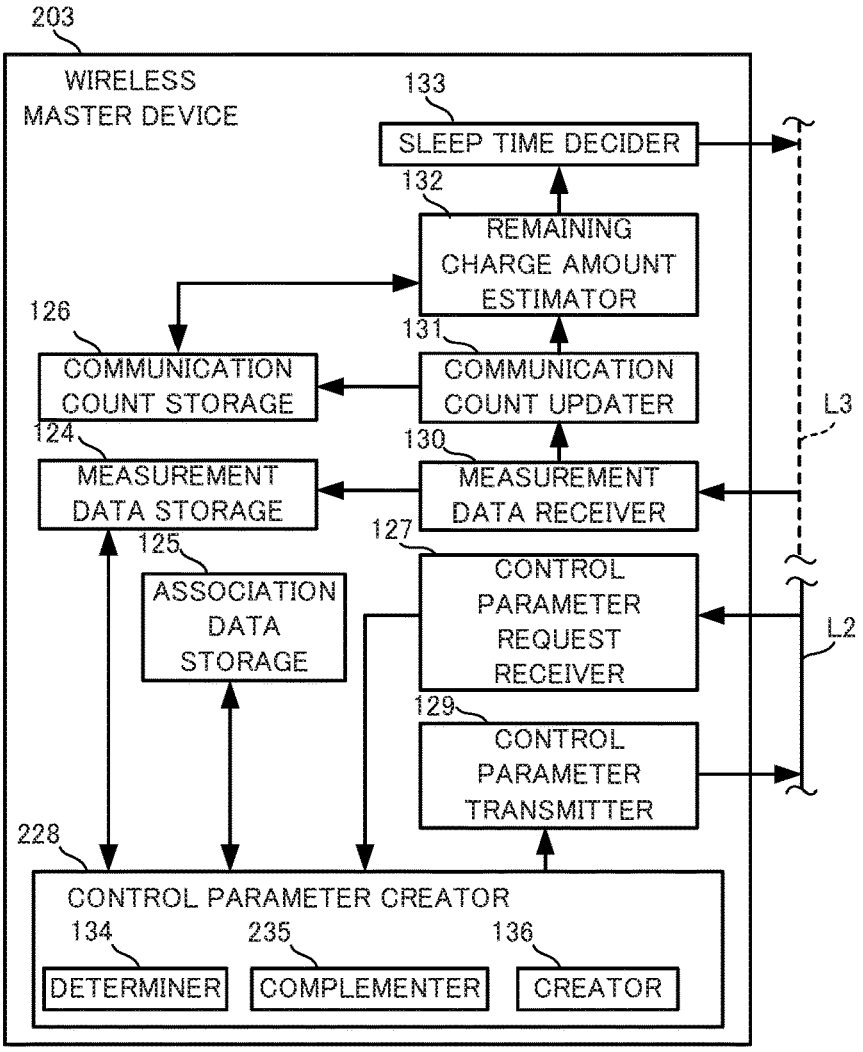
FIG. 19 is a diagram showing the functional configuration of a wireless master device according to Embodiment 2.

As shown in FIG. 19, the wireless master devices 203 functionally comprise a complementer 235 of a control parameter creator 228 in place of the complementer 135 of the control parameter creator 128 of the wireless master devices 103 according to Embodiment 1. The wireless master devices 203 and the wireless master devices 103 according to Embodiment 1 may be the same in the other functional configuration.

When there is a sensor device 104 for which the determiner 134 determined no measurement data including the most recent temperature is stored in the measurement data storage 124, like the complementer 135 according to Embodiment 1, the complementer 235 reads from the measurement data storage 124 measurement data including a temperature measured before a predetermined time by the sensor device 104.

In such a case, the complementer 235 further reads from the measurement data storage 124 measurement data including a temperature measured by sensor devices 104 other than the sensor device 104. The complementer 235 complements the temperature presented by the read measurement data so as to calculate a most recent temperature as a control parameter.

In order to calculate a most recent temperature that would be measured by a sensor device 104 of which measurement data including the most recent temperature are missing in the complementation procedure (corresponding to Step S135 in FIG. 13), the complementer 235 performs complementation with reference to measurement data of other sensor devices 104 in addition to past measurement data of the sensor device 104.

Figure 20:
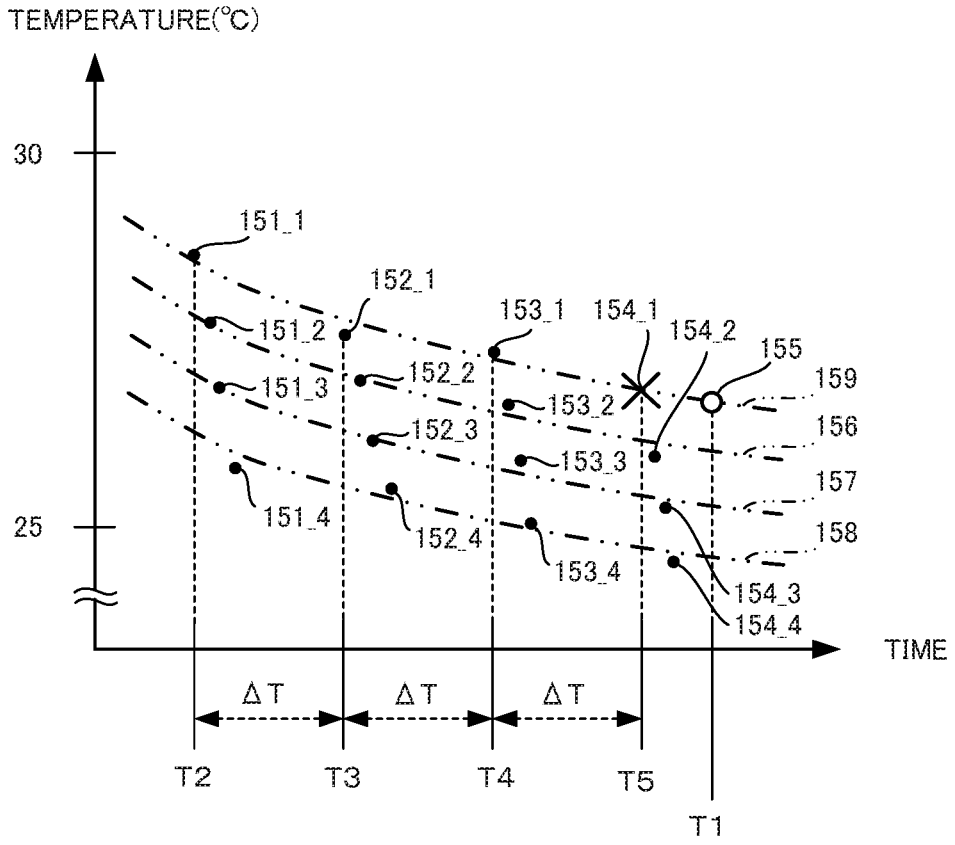
FIG. 20 is a graphical representation for explaining another exemplary method of complementing the temperature.

A case of calculating a temperature at the current time T1 by complementation with the method according to this embodiment will be described with reference to FIG. 20.

Figure 14:
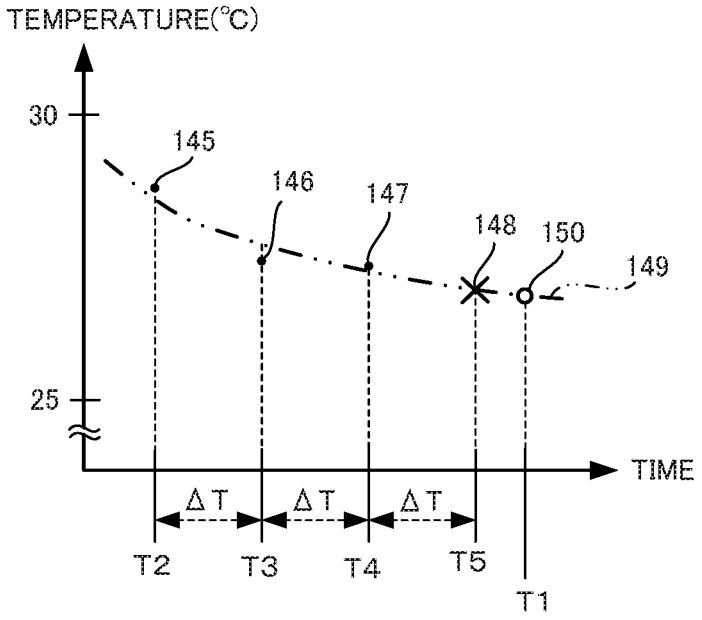
FIG. 14 is a graphical representation for explaining an exemplary method of complementing the temperature.

It is assumed that the current time T1 and the times T2 to T5 are the same as those in FIG. 14. In the case shown in FIG. 20, the measurement data storage 124 stores measurement data including temperatures 151_1, 152_1, and 153_1 measured at the times T2, T3, and T4, respectively, for the sensor device 104_1, but stores no measurement data including a most recent temperature 154_1 measured at the time T5.

It is assumed that measurement data including the temperatures measured nearly around the same times as the times T2, T3, T4, and T5 are stored for the sensor devices 104_2 to _4. In the same figure, temperatures 151_n, 152_n, 153_n, and 154 n present the temperatures measured by a sensor device 104_n (n is 2, 3, or 4) at the times T2, T3, T4, and T5, respectively.

Here, in the same figure, the temperatures measured nearly around the same times as the times T2, T3, T4, and T5 are shown between the times T2 and T3, the times T3 and T4, the times T4 and T5, and the times T5 and T1, respectively. It is assumed that the temperatures 154_2 to _4 measured at or nearly around the same time as the time T5 is the most recent temperatures at the current time T1.

For example, the complementer 235 derives an approximate expression presenting the relation of temperatures measured by the sensor devices 104_2 to _4 using the temperatures measured at each of the times T2 to T4. In more detail, for example, the complementer 235 derives an approximate expression presenting the best the relation of temperatures measured by the sensor devices 104_2 to _4 at the time T2, the relation of temperatures measured by the sensor devices 104_2 to _4 at the time T3, and the relation of temperatures measured by the sensor devices 104_2 to _4 at the time T4. The complementer 235 substitutes the temperatures 154_2 to _4 measured at the time T5 by the sensor devices 104_2 to _4, respectively, in the derived approximate expression to calculate a most recent temperature 155 of the sensor device 104_1 at the current temperature T1.

Moreover, for example, the complementer 235 derives an approximate function of the temperatures measured at the times T3 to T5 for each of the sensor devices 104_2 to _4. In more detail, for example, the complementer 235 obtains an approximate function 156 presenting the relation of the temperatures 152_2, 153_2, and 154_2 measured by the sensor device 104_2 at the times T3 to T5. The complementer 235 also obtains approximate functions 157 and 158 for the sensor devices 104_3 and _4, respectively. When the approximate functions 156, 157, and 158 are expressed by, for example, aT^2+bT+c (T is a variable presenting a time, "a", "b", and "c" are each a coefficient for each order, and presents a power), for example for "a" and "b", the averages of the approximate functions 156, 157, and 158 are used. Then, c is decided based on the temperature 153_1 measured at the latest time T4 among those measured by the sensor device 104_1, whereby an approximate function 159 of temperatures measured by the sensor device 104_1 is derived. The complementer 235 substitutes the time T1 in the derived approximate expression so as to calculate a most recent temperature of the sensor device 104_1 at the current time T1.

Also according to this embodiment, as in Embodiment 1, when no measurement data including the most recent temperature are received or stored, a temperature obtained by complementation is used as a control parameter for creating the control parameter data. As a result, the air conditioner 101 can be controlled based on a control parameter presenting a temperature relatively close to the actual measurement value even if measurement data including an actual temperature measurement value are missing because a prolonged sleep time is set. Therefore, it is possible to prevent the target space from being less comfortable because of missing measurement data.

Embodiment 3

In this embodiment, a case in which multiple sensor devices are classified depending on the remaining battery charge amount and the sleep times are decided so that the sensor devices in the same group run out of battery charge around the same time will be described.

The air conditioner control system according to this embodiment has the same configuration as in Embodiment 2 except for comprising wireless master devices 303 (303_1 and 303_2) different in functional configuration from the wireless master devices 203 (203_1 and 203_2) according to Embodiment 2.

Figure 21:
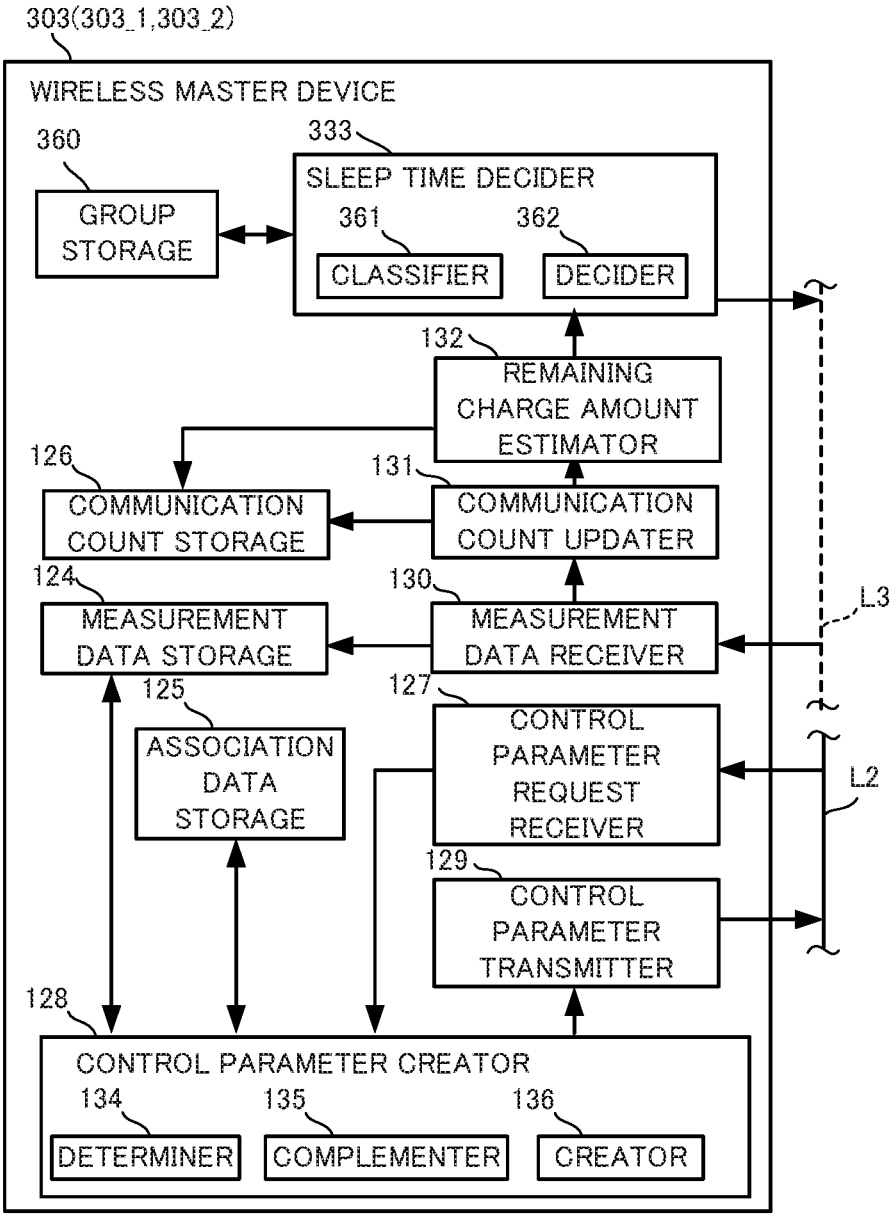
FIG. 21 is a diagram showing the functional configuration of a wireless master device according to Embodiment 3 of the present disclosure.

As shown in FIG. 21, the wireless master devices 303 functionally comprise a group storage 360 in addition to the configuration of the wireless master devices 203 according to Embodiment 2. The wireless master devices 303 comprise the control parameter creator 128 according to Embodiment 1 in place of the control parameter creator 228 of the wireless master devices 203 according to Embodiment 2 and a sleep time decider 333 in place of the sleep time decider 133 of the wireless master devices 203 according to Embodiment 2. Here, the control parameter creator 128 comprises the same function as the one according to Embodiment 1.

The group storage 360 stores group data presenting the sensor devices 104 in the same group. The group data associate, for example, a group ID that is the ID of a group with the communication addresses of the sensor devices 104 in the group. The group data may be cleared when, for example, any of the sensor devices 104 has the battery 119 replaced.

Like the sleep time decider 133 according to Embodiment 1, the sleep time decider 333 decides a sleep time that makes at least two sensor devices 104 run out of battery charge around the same time according to the remaining charge amount of the battery 119 estimated by the remaining charge amount estimator 132.

As shown in the same figure, the sleep time decider 333 has a classifier 361 dividing the sensor devices 104 into multiple groups and a decider 362 deciding the sleep times of the sensor devices 104.

The classifier 361 classifies the sensor devices 104 so that two or more sensor devices 104 belong to at least one group and the maximum difference in the remaining charge amount among the batteries 119 of the sensor devices 104 in the same group is smaller than the maximum difference in the remaining charge amount among the batteries 119 of all sensor devices 104.

The decider 362 decides the sleep time that makes the sensor devices 104 in the same group run out of battery charge around the same time according to the remaining charge amount of the battery 119 of each of the sensor devices 104 classified together by the classifier 361.

The configuration of the air conditioner control system according to this embodiment is described above. Operation of the air conditioner control system according to this embodiment will be described hereafter.

In the air conditioner control system according to this embodiment, the wireless master devices 303 execute the data collection control procedure (Step S2*b*) in place of the data collection control procedure (Step S2*a*) shown in FIG. 11, and the wireless master devices 303 operate in relation to the sensor devices 104_1 to _4. The sensor device 104_4 operates in the same manner as the other sensor devices 104_1 to _3. The other operation of the air conditioner control system according to this embodiment is the same as that of the air conditioner control system according to Embodiment 1

Figure 22:
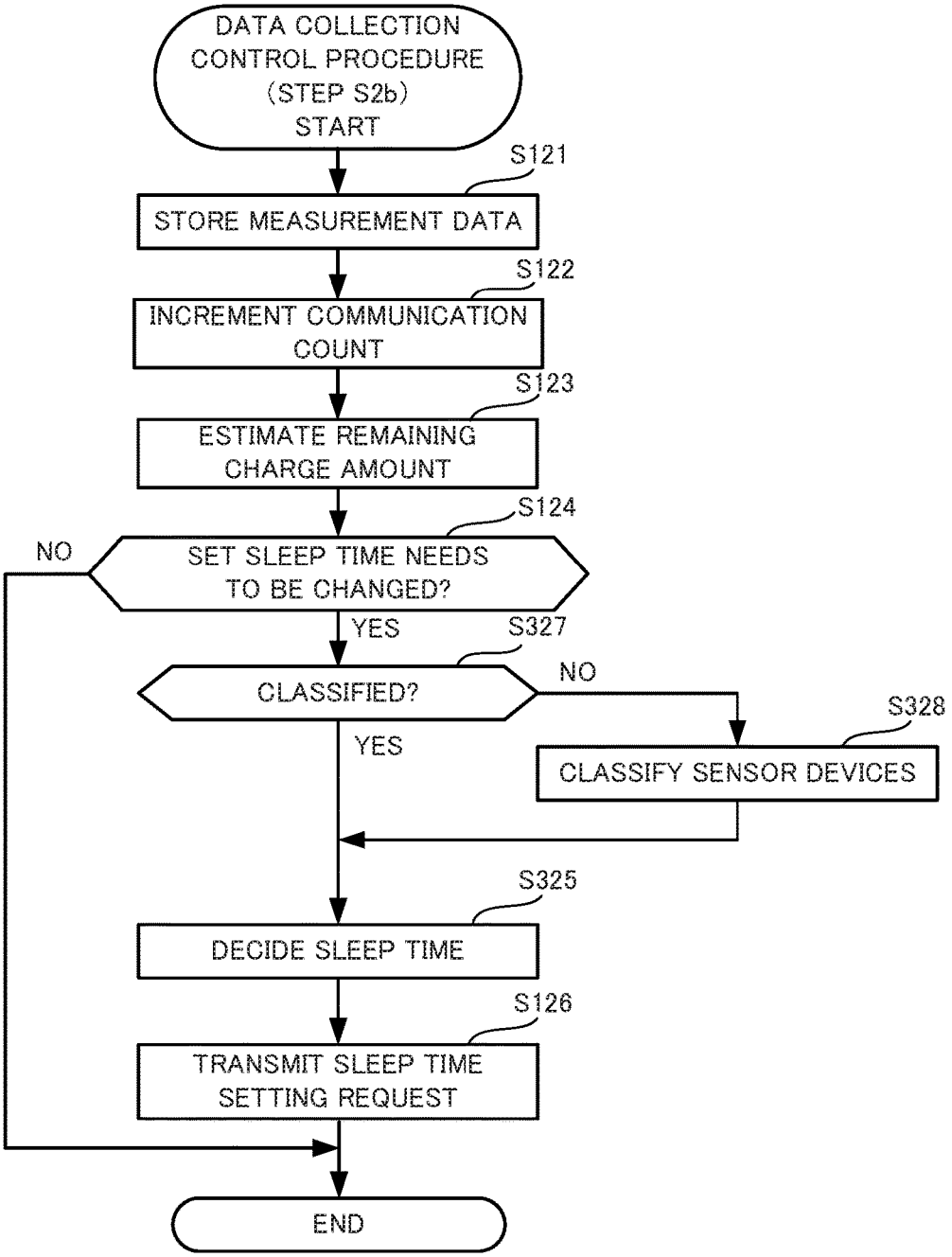
FIG. 22 is a flowchart showing the process flow of the data collection control procedure executed by a wireless master device according to Embodiment 3.

As shown in FIG. 22, in the data collection control procedure (Step S2*b*), after it is determined that the set sleep time needs to be changed in Step S124 of the collection control procedure (Step S2*a*) according to Embodiment 1 (Step S124; YES), Steps S327 and S328 are executed, and Step S325 replacing Step S125 is executed. The other processing included in the data collection control procedure (Step S2*b*) is the same as that of the data collection control procedure (Step S2*a*) according to Embodiment 1.

The classifier 361 executes the determination of Step S124 and if the set sleep time needs to be changed (Step S124; YES), makes reference to the group data in the group storage 360. The classifier 361 determines whether the sensor devices 104 are classified depending on whether any group data is stored in the group storage 360 (Step S327).

If no group data is stored in the group storage 360, the classifier 361 determines that no classification is done (Step S327; NO), and classifies the sensor devices 104 so that two or more sensor devices 104 belong to at least one group and the maximum difference in the remaining charge amount among the batteries 119 of the sensor devices 104 in the same group is smaller than the maximum difference in the remaining charge amount among the batteries 119 of all sensor devices 104 (Step S328).

Figure 23:
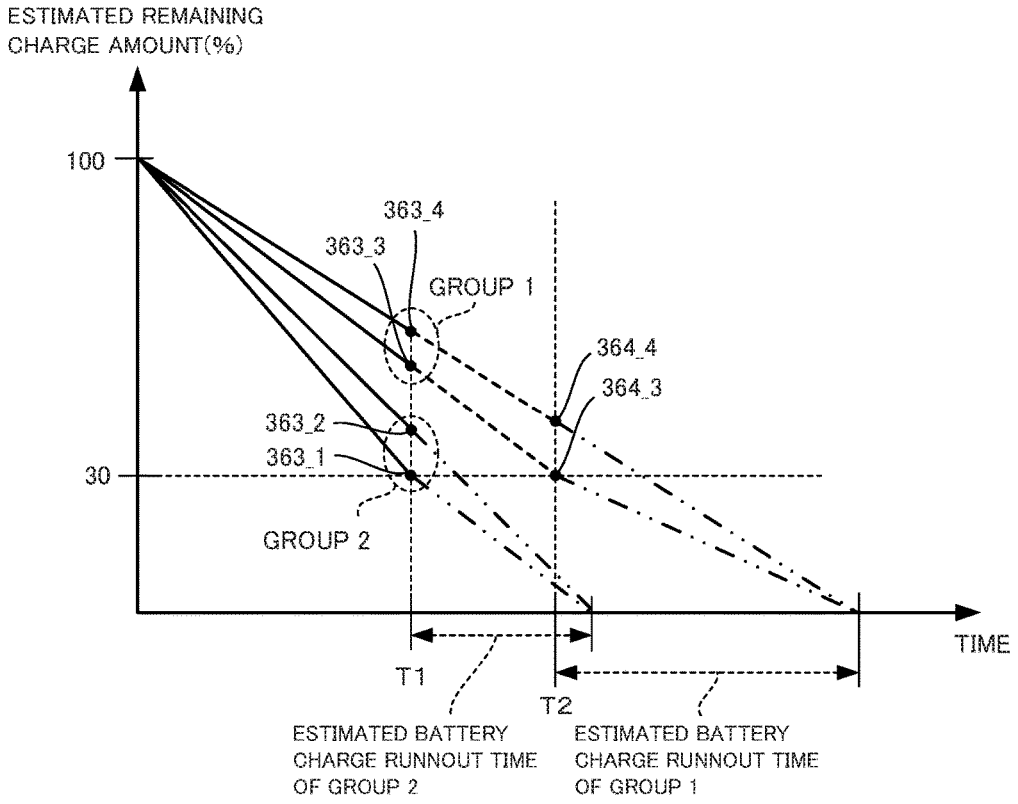
FIG. 23 is a graphical representation for explaining an exemplary method of classifying the sensor devices and an exemplary method of determining the sleep times of the groups.

A method of classification used by the wireless master devices 303 for the classification (Step S328) will be described with reference to FIG. 23.

It is assumed that temperatures 363_1 to _4 shown in the same figure are the estimated remaining battery charge amounts of the batteries 119 of the sensor devices 104_1 to _4 estimated by the remaining charge amount estimator 132 at a time T1. The estimated remaining battery charge amount 363_1 of the sensor device 104_1 at the time T1 is equal to a threshold 30 (%), whereby the classifier 361 determines that the set sleep time of the sensor device 104_1 needs to be changed (Step S124; YES). As shown in the same figure, the sensor devices 104_1 to _4 with which a wireless master device 303 communicates have their set sleep times changed at the time T1 for the first time; therefore, no group data is stored in the group storage 360 until then. The classifier 361 determines that no classification is done (Step S327; NO) and executes the classification (Step S328).

In Step S328 at the time T1, the classifier 361 identifies the sensor device 104_4 and sensor device 104_1 corresponding to the highest estimated remaining battery charge amount 363_4 and the lowest estimated remaining battery charge amount 363_1, respectively. The classifier 361 classifies the sensor device 104_4 corresponding to the highest estimated remaining battery charge amount 363_4 and the sensor device 104_3 corresponding to the estimated remaining battery charge amount 363_3 closest to the highest estimated remaining battery charge amount 363_4 into the same GROUP 1. The classifier 361 classifies the sensor device 104_1 corresponding to the lowest estimated remaining battery charge amount 363_1 and the sensor device 104_2 corresponding to the estimated remaining battery charge amount 363_2 closest to the lowest estimated remaining battery charge amount 363_1 into the same GROUP 2.

Here, the method of classification is not limited to the above.

For example, it may be possible to set the number of groups into which the sensor devices 104 communicating with a wireless master device 303 are divided and the number (limitation) of sensor devices 104 in each group, and classify the sensor devices 104 accordingly. In more detail, for example, it is assumed that the wireless master device 303_1 communicates with the sensor devices 104_1 to _4 and the wireless master device 303_1 is set to divide the sensor devices 104_1 to _4 into two groups of two each.

In such a case, the classifier 361 seeks for a threshold of the estimated remaining battery charge amount that can divide the sensor devices 104_1 to _4 communicating with the wireless master device 303_1 into groups of two each. The classifier 361 forms GROUP 1 to which the sensor devices 104_3 and _4 having estimated remaining battery charge amounts equal to or higher than the threshold belong and GROUP 2 to which the sensor devices 104_1 and _2 having estimated remaining battery charge amounts lower than the threshold belong.

For example, the classifier 361 may obtain the intermediate value of the highest value (363_4) and lower value (363_1) of the estimated remaining battery charge amounts and classify the sensor devices 104_1 to 4 into GROUP 1 of those equal to or higher than the intermediate value and GROUP 2 of those lower than the intermediate value.

For example, the classifier 361 may group together a combination of sensor devices 104 between which the difference in estimated remaining battery charge amount is smallest among the estimated remaining battery charge amounts 363_1 to _4. In such a case, the classifier 361 may further add to the group a sensor device 104 of which the difference in the estimated remaining battery charge amount from the other sensor devices 104 in the same group falls within a predetermined allowable range. As a result of such processing, if all of the sensor devices 104_1 to _4 belong to the same group, the classifier 361 may gradually narrow the predetermined allowable range until at least one sensor device 104 is excluded from the group.

As shown in FIG. 22, if any group data is stored in the group storage 360, the classifier 361 determines that classification is done (Step S327; YES). If classification is done (Step S327; YES) or after the classification (Step S328), the decider 362 decides the sleep time of a sensor device 104 of which the set sleep time is determined to need to be changed in Step S124 (Step S325). At this point, the decider 362 decides a sleep time that makes the sensor devices 104 in the same group as the target sensor device 104 to decide the sleep time run out of battery charge around the same time according to the estimated remaining battery charge amounts of the sensor devices 104 in the group.

With reference to FIG. 23 again, details of the sleep time determination (Step S325) are described. At the time T1, the decider 362 decides the sleep time of the sensor device 104_1 of which the setting is determined to need to be changed in Step S124. It is assumed that the sensor device 104_1 and sensor device 104_2 are classified into the GROUP 2 as described above. In such a case, the decider 362 calculates the time period in which the sensor device 104_2 runs out of battery (an estimated battery runout time of the GROUP 2) based on the estimated remaining battery charge amount of the sensor device 104_2 that is the highest in the GROUP 2. The decider 362 decides such a time period that the sensor device 104_1 runs out of battery in the estimated battery runout time of the GROUP 2 to be the sleep time of the sensor device 104_1.

Here, for example, it is assumed that the estimated remaining battery charge amount 364_3 of the sensor device 104_3 becomes 30% at a time T2. In such a case, the decider 362 calculates an estimated battery runout time of the GROUP 1 based on the estimated remaining battery charge amount 364_4 of the sensor device 104_4 of which the estimated remaining battery charge amount is the highest in the GROUP 1 in the same manner as described above. The decider 362 decides such a time period that the sensor device 104_3 runs out of battery in the estimated battery runout time of the GROUP 1 to be the sleep time of the sensor device 104_3.

According to this embodiment, the sensor devices 104 are classified so that two or more sensor devices 104 belong to at least one group. Then, the sleep time is decided so that the sensor devices 104 classified into the same group run out of battery charge around the same time. The sensor devices 104 will be in the sleep mode in which power consumption is lower than in the normal mode according to the decided sleep time. As a result, the batteries of two or more sensor devices 104 can be replaced around the same time. Therefore, it is possible to reduce maintenance-related labor accompanying exhaustion of the batteries.

Here, for example, in order to make the sensor devices 104 of which the remaining charge amounts of the batteries 119 are largely different and run out of battery charge around the same time, the sleep time of a sensor device 104 of which the remaining charge amount of the battery 119 is low may be extremely longer than the sleep times of the other sensor devices 104. Consequently, if an actual temperature measurement value is not obtained for a long time, it is likely that the temperature obtained by complementation is deviated from the actual value and the target space becomes less comfortable.

According to this embodiment, the sensor devices 104 are classified so that two or more sensor devices 104 belong to at least one group and the maximum difference in remaining charge amount among the batteries 119 of the sensor devices 104 in the same group is smaller than the maximum difference in the remaining charge amount among the batteries 119 of all sensor devices 104. The sleep time is decided so that the sensor devices 104 classified in the same group run out of battery charge around the same time. As a result, the sensor devices 104 of which the remaining charge amounts of the batteries 119 are relatively close to each other are made to run out of battery charge around the same time, whereby it is unlikely that the sleep time of any sensor device 104 is extremely longer than the sleep times of the other sensor devices 104. Therefore, it is possible to prevent the target space from being less comfortable in connection with a prolonged sleep time.

Embodiment 4

In this embodiment, a case in which the air conditioner control system comprises no wireless master devices and the integrated controller comprises the function of the wireless master devices will be described.

Figure 24:
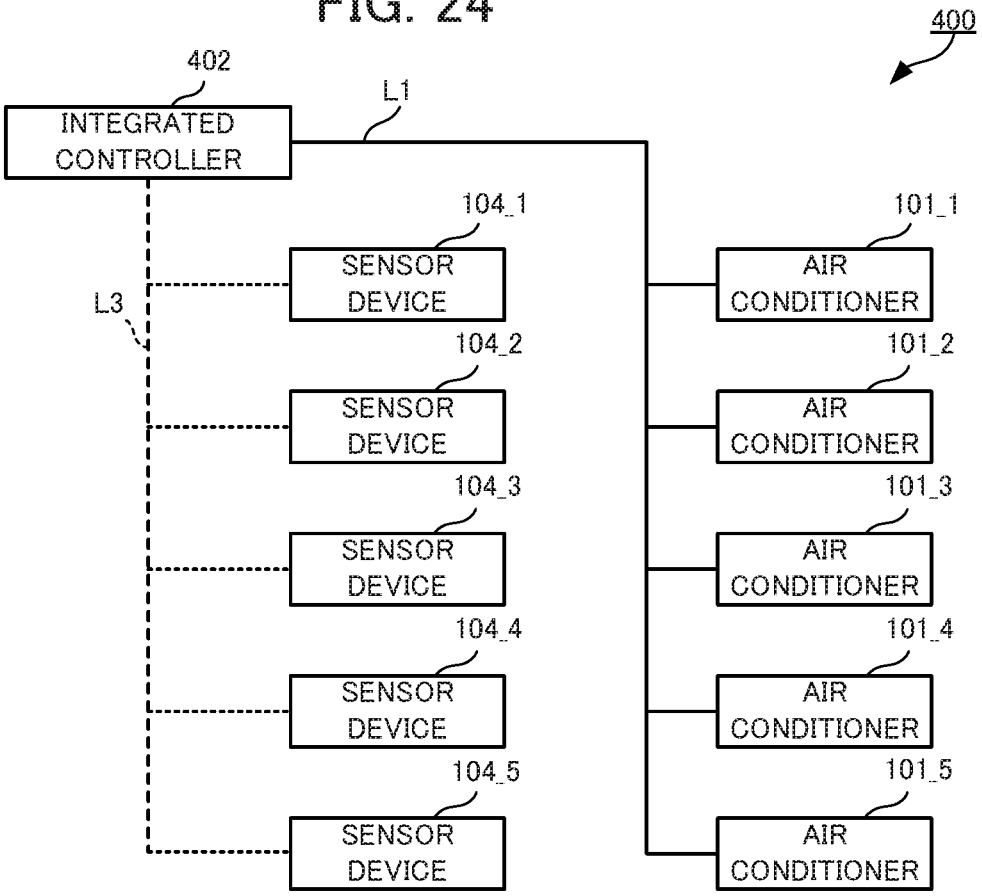
FIG. 24 is a diagram showing the configuration of the air conditioner control system according to Embodiment 4 of the present disclosure.
Figure 25:
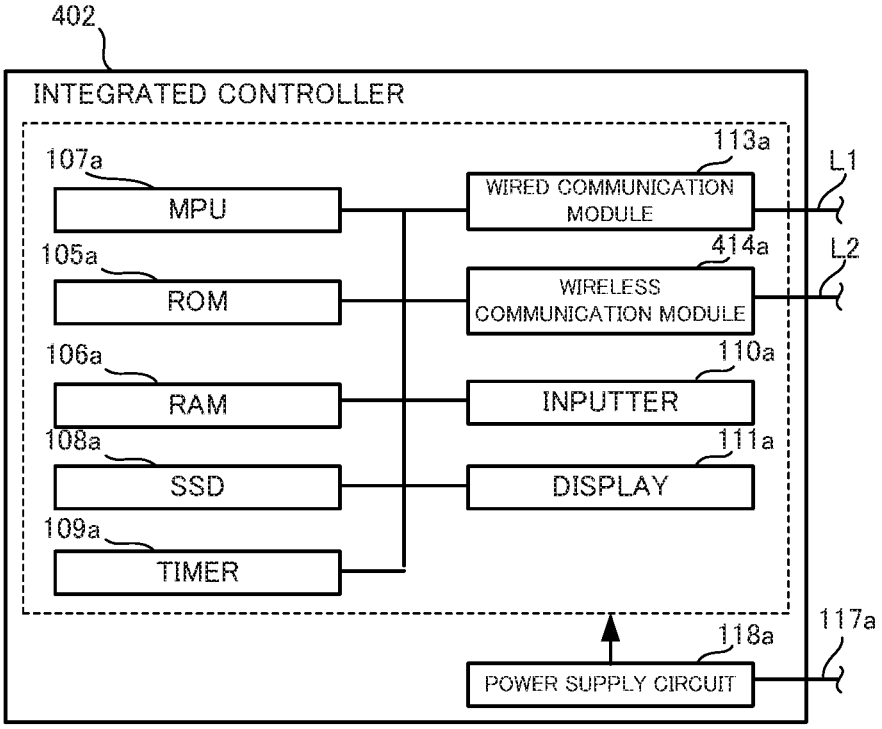
FIG. 25 is a diagram showing the physical configuration of the integrated controller according to Embodiment 4.

An air conditioner control system 400 according to this embodiment comprises, as shown in FIG. 24, no wireless master devices 103: an integrated controller 402 and the sensor devices 104_1 to _5 are communicably connected directly via the wireless communication line L3. The integrated controller 402 is physically different from the integrated controller 102 according to Embodiment 1 in comprising, as shown in FIG. 25, a wireless communication module 414*a* in place of the wired communication module 114*a*.

Figure 26:
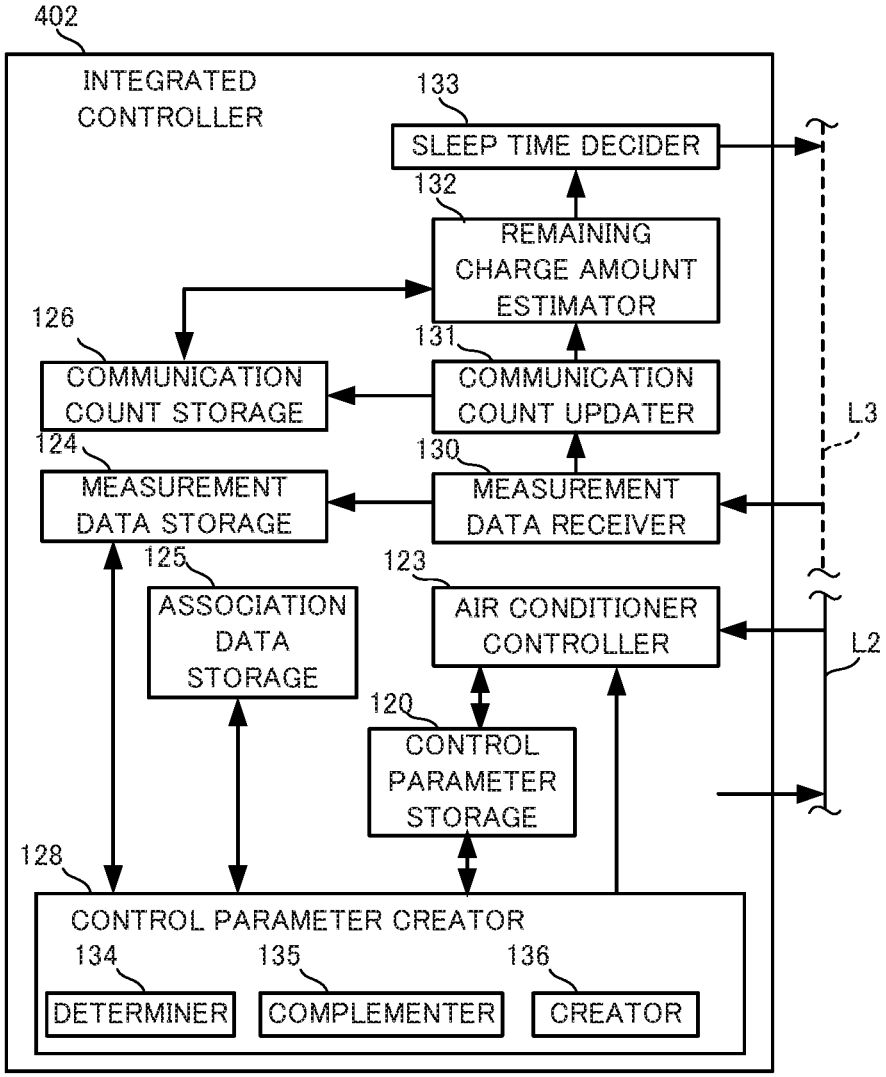
FIG. 26 is a diagram showing the functional configuration of the integrated controller according to Embodiment 4.

The integrated controller 402 functionally comprises, as shown in FIG. 26, all functions of the integrated controller 102 and the wireless master devices 103 according to Embodiment 1 except for the control parameter request transmitter 121, the control parameter request receiver 127, the control parameter transmitter 129, and the control parameter receiver 122.

According to this embodiment, since there are no wireless master devices 103, the air conditioner control system can have a simplified configuration.

Embodiments and modified embodiments of the present disclosure are described above. The present disclosure is not restricted to those embodiments. The present disclosure includes proper combinations of the above embodiments and modified embodiments and their modifications.

The present application claims the priority based on Japanese Patent Application No. 2013-179230, filed on Aug. 30, 2013, the disclosed contents of which are entirely incorporated herein by reference.

INDUSTRIAL APPLICABILITY

The disclosure according to the present application is preferably used in air conditioner control systems for controlling air conditioners, controlling sensor devices used for controlling air conditioners, and the like.

REFERENCE SIGNS LIST

100, 200, 400 Air conditioner control system
101_1 to _5 (101) Air conditioner
102, 402 Integrated controller
103_1 and _2 (103), 203_1 and _2 (203), 303_1 and _2 (303) Wireless master device
104_1 to _5 (104) Sensor device
119 Battery
120 Control parameter storage
121 Control parameter request transmitter
122 Control parameter receiver
123 Air conditioner controller
124 Measurement data storage
125 Association data storage
126 Communication count storage
127 Control parameter request receiver
128, 228 Control parameter creator
129 Control parameter transmitter
130 Measurement data receiver
131 Communication count updater
132 Remaining charge amount estimator
133, 333 Sleep time decider
134 Determiner
135, 235 Complementer
136 Creator
137 Sleep time storage
138 Wireless master device address storage
139 Measurer
140 Reception controller
141 Sleep controller
142 Awakener
360 Group storage
361 Classifier
362 Decider

The invention claimed is:

1. A control system comprising:

one or more facility apparatuses configured to condition an environment in a target space;

an integrated controller configured to communicate with the one or more facility apparatuses;

a plurality of sensor devices configured to communicate with the integrated controller; and a relay device configured to relay communication between each of the plurality of sensor devices and the integrated controller, wherein:

each of the plurality of sensor devices comprises a battery, the plurality of sensor devices are configured to be put, according to remaining charge amounts of the batteries, in a sleep mode in which power consumption is lower than in a normal mode so that at least two of the plurality of sensor devices run out of battery charge around the same time, the relay device comprises a sleep time decider configured to decide a first interval or a second interval according to the remaining charge amounts of the batteries, the first interval and the second interval differing from each other;

each of the plurality of sensor devices comprises a sleep controller configured to put a target sensor device of the plurality of sensor devices in the sleep mode at the first interval or the second interval decided by the sleep time decider, the integrated controller comprises an apparatus controller configured to control the one or more facility apparatuses based on control parameter data, each of the plurality of sensor devices further comprises a measurer configured to measure an environment value of the target space and send measurement data including the measured environment data to the relay device, the relay device further comprises a control parameter creator configured to create the control parameter data based on the measurement data received from each of the plurality of sensor devices, and the control parameter creator further comprises:

a determiner configured to determine whether measurement data including a most recent environment value measured within a predetermined time period is received from each of the plurality of sensor devices;

a complementer configured to create, when there is at least one sensor device of the plurality of sensor devices for which the determiner determined to not receive the measurement data including the most recent environment value, the control parameter data for the at least one sensor device by complementation using measurement data including environment values measured prior to the predetermined time period, among the measurement data received from the sensor device; and a creator configured to create, when there is at least one sensor device of the plurality of sensor devices for which the determiner determined to receive the measurement data including the most recent environment value, the control parameter data including the most recent environment value for the at least one sensor device.

2. The control system according to claim 1, wherein the complementer is configured to create, when there is at least one sensor device of the plurality of sensor devices for which the determiner determined to not receive the measurement data including the most recent environment value, the control parameter data for the at least one sensor device by complementation using measurement data including environment values measured prior to the predetermined time period among the measurement data received from the sensor device and measurement data received from the sensor devices other than the at least one sensor device.

3. The control system according to claim 1, wherein the one or more facility apparatuses comprise a plurality of facility apparatuses, the relay device further comprises an association data storage configured to store association data in which the plurality of sensor devices and the plurality of facility apparatuses are associated with each other, the control parameter creator is configured to create the control parameter data for each of the plurality of facility apparatuses based on the measurement data of which the transmission source is the sensor device associated with each of the plurality of facility apparatuses in the association data, among the measurement data received from each of the plurality of sensor devices, and the apparatus controller is configured to control the corresponding facility apparatus based on the control parameter data for each of the plurality of facility apparatuses created by the control parameter creator.

4. A control system comprising:

one or more facility apparatuses configured to condition an environment in a target space;

an integrated controller configured to communicate with the one or more facility apparatuses; and a plurality of sensor devices configured to communicate with the integrated controller, wherein:

each of the plurality of sensor devices comprises a battery, the plurality of sensor devices are configured to be put, according to remaining charge amounts of the batteries, in a sleep mode in which power consumption is lower than in a normal mode so that at least two of the plurality of sensor devices run out of battery charge around the same time, a sleep time decider is configured to decide a first interval or a second interval according to the remaining charge amounts of the batteries, the first interval and the second interval differing from each other;

each of the plurality f sensor devices comprises a sleep controller configured to put a target sensor device of the plurality of sensor devices in the sleep mode at the first interval or the second interval decided by the sleep time decider, and the sleep time decider comprises:

a classifier configured to classify three or more sensor devices of the plurality of sensor devices into a plurality of groups so that two or more sensor devices of the three or more sensor devices belong to at least one group and a largest difference in the remaining charge amount among the batteries of the two or more sensor devices in the same group is smaller than a largest difference in the remaining charge amount among the batteries of all of the three or more sensor devices; and a decider configured to decide, according to the remaining charge amount of the battery of each of the two or more sensor devices classified by the classifier into the same group, the first interval or the second interval so that the two or more sensor devices classified into the same group run out of battery charge around the same time.

5. The control system according to claim 1, wherein three or more sensor devices of the plurality of sensor devices are provided, the sleep time decider comprises:

a classifier configured to classify the three or more sensor devices into a plurality of groups so that two or more sensor devices of the three or more sensor devices belong to at least one group and a largest difference in the remaining charge amount among the batteries of the two or more sensor devices in the same group is smaller than a largest difference in the remaining charge amount among the batteries of all of the three or more sensor devices; and a decider configured to decide, according to the remaining charge amount of the battery of each of the two or more sensor devices classified by the classifier into the same group, the first interval or the second interval so that the two or more sensor devices classified into the same group run out of battery charge around the same time.

6. The control system according to claim 2, wherein three or more sensor devices of the plurality of sensor devices are provided, the sleep time decider comprises:

a classifier configured to classify the three or more sensor devices into a plurality of groups so that two or more sensor devices of the three or more sensor devices belong to at least one group and a largest difference in the remaining charge amount among the batteries of the two or more sensor devices in the same group is smaller than a largest difference in the remaining charge amount among the batteries of all of the three or more sensor devices; and a decider configured to decide, according to the remaining charge amount of the battery of each of the two or more sensor devices classified by the classifier into the same group, the first interval or the second interval so that the two or more sensor devices classified into the same group run out of battery charge around the same time.

7. The control system according to claim 3, wherein three or more sensor devices of the plurality of sensor devices are provided, the sleep time decider comprises:

a classifier configured to classify the three or more sensor devices into a plurality of groups so that two or more sensor devices of the three or more sensor devices belong to at least one group and a largest difference in the remaining charge amount among the batteries of the two or more sensor devices in the same group is smaller than a largest difference in the remaining charge amount among the batteries of all of the three or more sensor devices; and a decider configured to decide, according to the remaining charge amount of the battery of each of the two or more sensor devices classified by the classifier into the same group, the first interval or the second interval so that the two or more sensor devices classified into the same group run out of battery charge around the same time.

8. The control system according to claim 4, wherein the integrated controller comprises the sleep time decider.

9. A sensor device control method for controlling a plurality of sensor devices, the sensor device control method comprising:

putting the plurality of sensor devices, according to remaining charge amounts of batteries, in a sleep mode in which power consumption is lower than in a normal mode so that at least two of the plurality of sensor devices run out of battery charge around the same time, determining whether each of the plurality of sensor devices receives measurement data including a most recent environment value measured within a predetermined time period;

creating, when at least one sensor device of the plurality of sensor devices is determined to not receive the measurement data including the most recent environment value, control parameter data for facility apparatuses by complementation using measurement data including environment values measured prior to the predetermined time period, among the measurement data received from the sensor device; and creating, when at least one sensor device of the plurality of sensor devices is determined to receive the measurement data including the most recent environment value, the control parameter data including the most recent environment value for the at least one sensor device.

10. A non-transitory computer-readable recording medium having stored thereon a program for a computer communicating with three or more sensor devices, the program allowing the computer to execute the following:

to classify the three or more sensor devices into a plurality of groups so that two or more sensor devices of the three or more sensor devices belong to at least one group and a largest difference in the remaining charge amount among batteries of the two or more sensor devices in the same group is smaller than a largest difference in the remaining charge amount among batteries of all of the three or more sensor devices;

to decide, according to the remaining charge amount of the battery of each of the two or more sensor devices classified by the classifier into the same group, a first interval or a second interval that is different from the first interval so that the two or more sensor devices classified into the same group run out of battery charge around the same time; and to control a target sensor device to be put in a sleep mode at the first interval or the second interval.

11. A sensor device control method configured to control three or more sensor devices, comprising:

classifying the three or more sensor devices into a plurality of groups so that two or more sensor devices of the three or more sensor devices belong to at least one group and a largest difference in the remaining charge amount among batteries of the two or more sensor devices in the same group is smaller than a largest difference in the remaining charge amount among batteries of all of the three or more sensor devices;

deciding, according to the remaining charge amount of the battery of each of the two or more sensor devices classified by the classifier into the same group, a first interval or a second interval that is different from the first interval so that the two or more sensor devices classified into the same group run out of battery charge around the same time; and controlling a target sensor device to be put in a sleep mode at the first interval or the second interval.

12. The control system according to claim 1, wherein the relay device further comprises a remaining charge amount estimator configured to estimate the remaining charge amounts of the batteries based on communication history with each of the plurality of sensor devices, and the sleep time decider is configured to decide, according to the remaining charge amounts of the batteries estimated by the remaining charge amount estimator, the first interval or the second interval so that the at least two sensor devices of the plurality of sensor devices run out of battery charge around the same time.

13. The control system according to claim 12, wherein the sleep time decider comprises:

a classifier configured to classify three or more sensor devices of the plurality of sensor devices into a plurality of groups so that two or more sensor devices of the three or more sensor devices belong to at least one group and a largest difference in the remaining charge amount among the batteries of the two or more sensor devices in the same group is smaller than a largest difference in the remaining charge amount among the batteries of all of the three or more sensor devices; and a decider configured to decide, according to the remaining charge amount of the battery of each of the two or more sensor devices classified by the classifier into the same group, the first interval or the second interval so that the two or more sensor devices classified into the same group run out of battery charge around the same time.

* * * * *